US011361958B2

(12) United States Patent
Gordon et al.

(10) Patent No.: US 11,361,958 B2
(45) Date of Patent: Jun. 14, 2022

(54) QUADRUPOLE DEVICES

(71) Applicant: Micromass UK Limited, Wilmslow (GB)

(72) Inventors: David Gordon, Middlewich (GB); David Langridge, Macclesfield (GB); Martin Raymond Green, Bowdon (GB); Richard Moulds, Stockport (GB); Daniel J. Kenny, Knutsford (GB); Kenneth Worthington, Middlewich (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/970,252

(22) PCT Filed: Feb. 15, 2019

(86) PCT No.: PCT/GB2019/050404
§ 371 (c)(1),
(2) Date: Aug. 14, 2020

(87) PCT Pub. No.: WO2019/158930
PCT Pub. Date: Aug. 22, 2019

(65) Prior Publication Data

US 2021/0082680 A1 Mar. 18, 2021

(30) Foreign Application Priority Data

Feb. 16, 2018 (GB) ..... 1802589
Feb. 16, 2018 (GB) ..... 1802601

(51) Int. Cl.
*H01J 49/42* (2006.01)
*H01J 49/00* (2006.01)

(52) U.S. Cl.
CPC ..... *H01J 49/4215* (2013.01); *H01J 49/0031* (2013.01); *H01J 49/429* (2013.01); *H01J 49/4275* (2013.01)

(58) Field of Classification Search
CPC ..... H01J 49/4215; H01J 49/0031; H01J 49/4275; H01J 49/429
(Continued)

(56) References Cited

U.S. PATENT DOCUMENTS 5,227,629 A 7/1993 Miseki
5,561,291 A 10/1996 Kelley et al.
(Continued)

FOREIGN PATENT DOCUMENTS

CN 105957797 A 9/2016
GB 2278232 A 11/1994
(Continued)

OTHER PUBLICATIONS

Search Report under Section 17(5) for United Kingdom Patent Application No. GB 1802589.0, dated Aug. 2, 2018, 4 pages.
(Continued)

*Primary Examiner* — Nicole M Ippolito

(57) ABSTRACT

A method of operating a quadrupole device is disclosed. The method comprises operating the quadrupole device in a first mode of operation, wherein ions within a first mass to charge ratio range are selected and/or transmitted by the quadrupole device, and operating the quadrupole device in a second mode of operation, wherein ions within a second different mass to charge ratio range are selected and/or transmitted by the quadrupole device. In the first mode of operation, the quadrupole device is operated in a normal mode of operation wherein a main drive voltage is applied to the quadrupole device, or in a first X-band or Y-band mode of operation wherein a main drive voltage and two or more auxiliary
(Continued)

drive voltages are applied to the quadrupole device. In the second mode of operation, the quadrupole device is operated in a second X-band or Y-band mode of operation wherein a main drive voltage and two or more auxiliary drive voltages are applied to the quadrupole device.

20 Claims, 19 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 5,747,801 | A | 5/1998 | Quarmby et al. | |
| 6,140,641 | A | 10/2000 | Yoshinari et al. | |
| 7,034,292 | B1 | 4/2006 | Whitehouse et al. | |
| 10,991,567 | B2 | 4/2021 | Langridge et al. | |
| 2002/0074492 | A1 | 6/2002 | Taniguchi | |
| 2004/0232328 | A1 | 11/2004 | Ding et al. | |
| 2007/0295900 | A1 | 12/2007 | Konenkov et al. | |
| 2010/0116982 | A1 | 5/2010 | Iwamoto et al. | |
| 2015/0097113 | A1 | 4/2015 | Campbell et al. | |
| 2018/0047549 | A1* | 2/2018 | Quaas | H01J 49/40 |
| 2021/0082679 | A1* | 3/2021 | Green | H01J 49/429 |

FOREIGN PATENT DOCUMENTS

| | | | |
|---|---|---|---|
| GB | 2301705 | A | 12/1996 |
| GB | 2421842 | A | 7/2006 |
| WO | 2017206965 | A1 | 12/2017 |
| WO | 2018046905 | A1 | 3/2018 |
| WO | 2020183159 | A1 | 9/2020 |
| WO | 2020183160 | A1 | 9/2020 |

OTHER PUBLICATIONS

Sudakov et al., "Possibility of Operating Quadrupole Mass Filter at High Resolution", International Journal of Mass Spectrometry, vol. 408, pp. 9-19, Sep. 2016.

Sudakov et al., "The Use of Stability Bands to Improve the Performance of Quadrupole Mass Filters", Technical Physics, vol. 61, pp. 107-115, Jan. 2017.

International Search Report and Written Opinion of International Patent Application No. PCT/GB2019/050404, dated May 3, 2019, 16 pages.

Combined Search and Examination Report under Sections 17 and 18(3) for United Kingdom Patent Application No. GB1902127.8, dated Aug. 8, 2019, 6 pages.

Konenkov et al., "Quadrupole Mass Filter Acceptance in Stability Island Created by Double-Frequency Quadrupole Excitation", European Journal of Mass Spectrometry, vol. 24, pp. 315-321, Feb. 2018.

Search Report under Section 17(5) for United Kingdom Patent Application No. GB1802601.3, dated Aug. 2, 2018, 3 pages.

International Search Report and Written Opinion for International Patent Application No. PCT/GB2019/050405, dated May 8, 2019, 14 pages.

Combined Search and Examination Report under Sections 17 and 18(3) for United Kingdom Patent Application No. GB1902115.3, dated Aug. 6, 2019, 7 pages.

Gershman, D.J., et al. "Higher order parametric excitation modes for spaceborne quadrupole mass spectrometers." Review of Scientific Instruments 82:125109-1 through 125109-15 (2011).

Konenkov, N.V., et al., "Quadrupole mass filter operation with auxiliary quadrupolar excitation: theory and experiment", International Journal of Mass Spectrometry 208:17-27 (2001).

Quadrupole Mass Spectrometry and Its Applications by P. Dawson (American Inst. of Physics, 1997) Abstract.

Combined Search and Examination Report under Sections 17 and 18(3), for Application No. GB2003532.5, dated Sep. 7, 2020, 6 pages.

International Search Report and Written Opinion for International application No. PCT/GB2020/050592, dated Jun. 16, 2020, 15 pages.

Douglas, D.J., and Konenkov, NV., "Quadrupole mass filter operation with dipole direct current and quadrupole radiofrequency excitation", Rapid Communications in Mass Spectrometry 32:1971-1977 (2018).

Combined Search and Examination Report under Sections 17 and 18(3), Application No. GB2003530.9 dated Sep. 7, 2020, 7 pages.

Examination Report under Section 18(3) for Application No. GB2003530.9, dated Jul. 30, 2021, 5 pages.

International Search Report and Written Opinion for International application No. PCT/GB2020/050591, dated Jun. 4, 2020, 13 pages.

* cited by examiner

QUADRUPOLE DEVICES

CROSS-REFERENCE TO RELATED APPLICATIONS

This application is a U.S. national phase filing claiming the benefit of and priority to International Patent Application No. PCT/GB2019/050404, filed Feb. 15, 2019, which claims priority from and the benefit of United Kingdom patent application No. 1802589.0 filed on Feb. 16, 2018 and United Kingdom patent application No. 1802601.3 filed on Feb. 16, 2018. The entire contents of these applications are incorporated herein by reference.

FIELD OF THE INVENTION

The present invention relates generally to quadrupole devices and analytical instruments such as mass and/or ion mobility spectrometers that comprise quadrupole devices, and in particular to quadrupole mass filters and analytical instruments that comprise quadrupole mass filters.

BACKGROUND

Quadrupole mass filters are well known and comprise four parallel rod electrodes. FIG. 1 shows a typical arrangement of a quadrupole mass filter.

In conventional operation, an RF voltage and a DC voltage are applied to the rod electrodes of the quadrupole so that the quadrupole operates in a mass or mass to charge ratio resolving mode of operation. Ions having mass to charge ratios within a desired mass to charge ratio range will be onwardly transmitted by the mass filter, but undesired ions having mass to charge ratio values outside of the mass to charge ratio range will be substantially attenuated.

The article M. Sudakov et al., International Journal of Mass Spectrometry 408 (2016) 9-19 (Sudakov), describes a mode of operation in which two additional AC excitations of a particular form are applied to the rod electrodes of the quadrupole (in addition to the main RF and DC voltages). This has the effect of creating a narrow and long band of stability along the high q boundary near the top of the first stability region (the "X-band"). Operation in the X-band mode can offer high mass resolution and fast mass separation.

The Applicants believe that there remains scope for improvements to quadrupole devices.

SUMMARY

According to an aspect there is provided a method of operating a quadrupole device comprising:

operating the quadrupole device in a first mode of operation, wherein ions within a first mass to charge ratio range are selected and/or transmitted by the quadrupole device; and operating the quadrupole device in a second mode of operation, wherein ions within a second different mass to charge ratio range are selected and/or transmitted by the quadrupole device;

wherein operating the quadrupole device in the first mode of operation comprises operating the quadrupole device in a normal mode of operation wherein a main drive voltage is applied to the quadrupole device, or operating the quadrupole device in a first X-band or Y-band mode of operation wherein a main drive voltage and two or more auxiliary drive voltages are applied to the quadrupole device; and wherein operating the quadrupole device in the second mode of operation comprises operating the quadrupole device in a second X-band or Y-band mode of operation wherein a main drive voltage and two or more auxiliary drive voltages are applied to the quadrupole device.

Various embodiments are directed to a method of operating a quadrupole device, such as a quadrupole mass filter, in which the quadrupole device is operated in a first mode of operation when selecting and/or transmitting ions within a first mass to charge ratio range, and is operated in a second different mode of operation when selecting and/or transmitting ions within a second different mass to charge ratio range.

The first mode of operation can be a normal mode of operation (wherein a main drive voltage is applied to the quadrupole device), or an X-band or Y-band mode of operation (wherein a main drive voltage and two or more auxiliary drive voltages are applied to the quadrupole device). The second mode of operation can be an X-band or Y-band mode of operation (wherein a main drive voltage and two or more auxiliary drive voltages are applied to the quadrupole device).

As will be described in more detail below, by configuring the quadrupole device to be operable in different modes of operation for different mass to charge ratio ranges, the most suitable and beneficial mode of operation can be selected and used for a given mass to charge ratio range. Thus, for example, where it is desired to use a relatively high resolution mode of operation, e.g. for relatively high mass to charge ratio ions, then a relatively high resolution X-band or Y-band mode of operation may be used. Where it is desired to use a relatively low resolution mode of operation, e.g. for relatively low mass to charge ratio ions, then the normal mode of operation may be used or a relatively low resolution X-band or Y-band mode of operation may be used.

It will be appreciated, therefore, that the present invention provides an improved quadrupole device.

The method may comprise applying one or more DC voltages to the quadrupole device.

Operating the quadrupole device in the first mode of operation may comprise operating the quadrupole device with a first resolution, and operating the quadrupole device in the second mode of operation may comprise operating the quadrupole device with a second different resolution.

The first mass to charge ratio range may be at least partially lower than the second mass to charge ratio range. That is, the first mass to charge ratio range may encompass lower mass to charge ratio values than the second mass to charge ratio range.

The second mass to charge ratio range may be at least partially higher than the first mass to charge ratio range. That is, the second mass to charge ratio range may encompass higher mass to charge ratio values than the first mass to charge ratio range.

The first mass to charge ratio range may be partially lower than the second mass to charge ratio range (and the second mass to charge ratio range may be partially higher than the first mass to charge ratio range), that is, the first mass to charge ratio range may partially overlap with the second mass to charge ratio range; or the first mass to charge ratio range may be entirely lower than the second mass to charge ratio range (and the second mass to charge ratio range may be entirely higher than the first mass to charge ratio range), that is, the first mass to charge ratio range and the second mass to charge ratio range may be non-overlapping ranges.

The first resolution may be less than the second resolution.

The method may comprise altering the resolution of the quadrupole device in the first and/or second mode of operation.

The method may comprise altering the mass to charge ratio or mass to charge ratio range at which ions are selected and/or transmitted by the quadrupole device in the first and/or second mode of operation. That is, the method may comprise altering the set mass of the quadrupole device in the first and/or second mode of operation.

The method may comprise altering the resolution of the quadrupole device in dependence on the mass to charge ratio or mass to charge ratio range at which ions are selected and/or transmitted by the quadrupole device (that is, in dependence on the set mass of the quadrupole device).

The method may comprise increasing the resolution of the quadrupole device while increasing the mass to charge ratio or mass to charge ratio range at which ions are selected and/or transmitted by the quadrupole device (that is, while increasing the set mass of the quadrupole device).

The method may comprise decreasing the resolution of the quadrupole device while decreasing the mass to charge ratio or mass to charge ratio range at which ions are selected and/or transmitted by the quadrupole device (that is, while decreasing the set mass of the quadrupole device).

As used herein, the set mass of the quadrupole device is the mass to charge ratio or the centre of the mass to charge ratio range at which ions are selected and/or transmitted by the quadrupole device.

The method may comprise altering the resolution of the quadrupole device by: (i) altering an amplitude of one or more of the auxiliary drive voltages; (ii) altering an amplitude ratio between the auxiliary drive voltages and the main drive voltage; (iii) altering an amplitude ratio between two or more of the auxiliary drive voltages; (iv) altering a frequency of one or more of the auxiliary drive voltages; (v) altering a frequency ratio between one or more of the auxiliary drive voltages and the main drive voltage; (vi) altering a frequency ratio between two or more of the auxiliary drive voltages; (vii) altering the duty cycle of the main drive voltage; and/or (viii) altering an amplitude ratio between a DC voltage applied to the quadrupole device and the main drive voltage.

Operating the quadrupole device in the first mode of operation may comprise operating the quadrupole device in a normal mode of operation wherein a main drive voltage is applied to the quadrupole device; and operating the quadrupole device in the second mode of operation may comprise operating the quadrupole device in an X-band or Y-band mode of operation wherein a main drive voltage and two or more auxiliary drive voltages are applied to the quadrupole device.

The method may comprise altering the resolution of the quadrupole device by altering the amplitudes of the two or more auxiliary drive voltages.

Operating the quadrupole device in the first mode of operation may comprise operating the quadrupole device in a first X-band or Y-band mode of operation wherein a main drive voltage and two or more auxiliary drive voltages are applied to the quadrupole device; and operating the quadrupole device in the second mode of operation may comprise operating the quadrupole device in a second different X-band or Y-band mode of operation wherein a main drive voltage and two or more auxiliary drive voltages are applied to the quadrupole device.

In the first X-band or Y-band mode of operation the two or more auxiliary drive voltages may comprise a particular auxiliary drive voltage pair type.

In the second different X-band or Y-band mode of operation the two or more auxiliary drive voltages may comprise a different auxiliary drive voltage pair type.

Operating the quadrupole device in the first mode of operation may comprise operating the quadrupole device in a Y-band mode of operation wherein a main drive voltage and two or more auxiliary drive voltages are applied to the quadrupole device; and operating the quadrupole device in the second mode of operation may comprise operating the quadrupole device in an X-band mode of operation wherein a main drive voltage and two or more auxiliary drive voltages are applied to the quadrupole device.

The two or more auxiliary drive voltages may comprise a first auxiliary drive voltage having a first amplitude $V_{ex1}$ and a second auxiliary drive voltage having a second amplitude $V_{ex2}$.

The method may comprise altering the resolution of the quadrupole device by altering an amplitude ratio between two or more of the auxiliary drive voltages.

In the first and/or second X-band or Y-band mode of operation:

each of the two or more auxiliary drive voltages may have a different frequency to the main drive voltage; and/or the two or more auxiliary drive voltages may comprise two or more auxiliary drive voltages having at least two different frequencies.

In the first and/or second X-band or Y-band mode of operation:

the main drive voltage may have a main drive voltage frequency $\Omega$; and the two or more auxiliary drive voltages may comprise a first auxiliary drive voltage having a first frequency $\omega_{ex1}$, and a second auxiliary drive voltage having a second different frequency $\omega_{ex2}$, wherein the main drive voltage frequency $\Omega$ and the first and second frequencies $\omega_{ex1}$, $\omega_{ex2}$ may be related by $\omega_{ex1}=v_1\Omega$, and $\omega_{ex2}=v_2\Omega$, where $v_1$ and $v_2$ are constants.

In the first and/or second X-band or Y-band mode of operation:

the first and second auxiliary drive voltages may comprise (i) a first auxiliary drive voltage pair type, wherein $v_1=v$ and $v_2=1-v$; (ii) a second auxiliary drive voltage pair type, wherein $v_1=v$ and $v_2=1+v$; (iii) a third auxiliary drive voltage pair type, wherein $v_1=1-v$ and $v_2=2-v$; (iv) a fourth auxiliary drive voltage pair type, wherein $v_1=1-v$ and $v_2=2+v$; (v) a fifth auxiliary drive voltage pair type, wherein $v_1=1+v$ and $v_2=2-v$; or (vi) a sixth auxiliary drive voltage pair type, wherein $v_1=1+v$ and $v_2=2+v$.

In the first and/or second X-band or Y-band mode of operation:

the two or more auxiliary drive voltages may comprise a first auxiliary drive voltage having a first amplitude $V_{ex1}$, and a second auxiliary drive voltage having a second different amplitude $V_{ex2}$, wherein the absolute value of the ratio of the second amplitude to the first amplitude $V_{ex2}/V_{ex1}$ may be in the range 1-10.

The main drive voltage and/or the two or more auxiliary drive voltages may comprise digital drive voltages.

The method may comprise operating the quadrupole device using two or more calibration curves.

The method may comprise operating the quadrupole device in the first mode of operation using a first calibration function.

The method may comprise operating the quadrupole device in the second mode of operation using a second different calibration function.

According to an aspect there is provided a method of operating a quadrupole device comprising:

operating the quadrupole device in a first mode of operation, wherein ions within a first mass to charge ratio range are selected and/or transmitted by the quadrupole device; and operating the quadrupole device in a second mode of operation, wherein ions within a second different mass to charge ratio range are selected and/or transmitted by the quadrupole device;

wherein operating the quadrupole device in the first mode of operation comprises operating the quadrupole device using a first calibration function; and wherein operating the quadrupole device in the second mode of operation comprises operating the quadrupole device using a second different calibration function.

According to an aspect there is provided a method of mass and/or ion mobility spectrometry comprising:

operating a quadrupole device using the method described above; and passing ions though the quadrupole device such that the ions are selected and/or filtered according to their mass to charge ratio.

According to an aspect there is provided apparatus comprising:

a quadrupole device; and a control system;

wherein the control system is configured:

(i) to operate the quadrupole device in a first mode of operation, wherein ions within a first mass to charge ratio range are selected and/or transmitted by the quadrupole device; and (ii) to operate the quadrupole device in a second mode of operation, wherein ions within a second different mass to charge ratio range are selected and/or transmitted by the quadrupole device;

wherein the control system is configured to operate the quadrupole device in the first mode of operation by operating the quadrupole device in a normal mode of operation wherein a main drive voltage is applied to the quadrupole device, or by operating the quadrupole device in a first X-band or Y-band mode of operation wherein a main drive voltage and two or more auxiliary drive voltages are applied to the quadrupole device; and wherein the control system is configured to operate the quadrupole device in the second mode of operation by operating the quadrupole device in a second X-band or Y-band mode of operation wherein a main drive voltage and two or more auxiliary drive voltages are applied to the quadrupole device.

The quadrupole device may comprise one or more voltage sources configured to apply one or more DC voltages to the electrodes.

The control system may be configured to operate the quadrupole device in the first mode of operation by operating the quadrupole device with a first resolution, and to operate the quadrupole device in the second mode of operation by operating the quadrupole device with a second different resolution.

The first mass to charge ratio range may be at least partially lower than the second mass to charge ratio range. That is, the first mass to charge ratio range may encompass lower mass to charge ratio values than the second mass to charge ratio range.

The second mass to charge ratio range may be at least partially higher than the first mass to charge ratio range. That is, the second mass to charge ratio range may encompass higher mass to charge ratio values than the first mass to charge ratio range.

The first mass to charge ratio range may be partially lower than the second mass to charge ratio range (and the second mass to charge ratio range may be partially higher than the first mass to charge ratio range), that is, the first mass to charge ratio range may partially overlap with the second mass to charge ratio range; or the first mass to charge ratio range may be entirely lower than the second mass to charge ratio range (and the second mass to charge ratio range may be entirely higher than the first mass to charge ratio range), that is, the first mass to charge ratio range and the second mass to charge ratio range may be non-overlapping ranges.

The first resolution may be less than the second resolution.

The control system may be configured to alter the resolution of the quadrupole device in the first and/or second mode of operation.

The control system may be configured to alter the mass to charge ratio or mass to charge ratio range at which ions are selected and/or transmitted by the quadrupole device in the first and/or second mode of operation. That is, the control system may be configured to alter the set mass of the quadrupole device in the first and/or second mode of operation.

The control system may be configured to alter the resolution of the quadrupole device in dependence on the mass to charge ratio or mass to charge ratio range at which ions are selected and/or transmitted by the quadrupole device (that is, in dependence on the set mass of the quadrupole device).

The control system may be configured to increase the resolution of the quadrupole device while increasing the mass to charge ratio or mass to charge ratio range at which ions are selected and/or transmitted by the quadrupole device (that is, while increasing the set mass of the quadrupole device).

The control system may be configured to decrease the resolution of the quadrupole device while decreasing the mass to charge ratio or mass to charge ratio range at which ions are selected and/or transmitted by the quadrupole device (that is, while decreasing the set mass of the quadrupole device).

The set mass of the quadrupole device may be the mass to charge ratio or the centre of the mass to charge ratio range at which ions are selected and/or transmitted by the quadrupole device.

The control system may be configured to alter the resolution of the quadrupole device by: (i) altering an amplitude of one or more of the auxiliary drive voltages; (ii) altering an amplitude ratio between the auxiliary drive voltages and the main drive voltage; (iii) altering an amplitude ratio between two or more of the auxiliary drive voltages; (iv) altering a frequency of one or more of the auxiliary drive voltages; (v) altering a frequency ratio between one or more of the auxiliary drive voltages and the main drive voltage; (vi) altering a frequency ratio between two or more of the auxiliary drive voltages; (vii) altering the duty cycle of the main drive voltage; and/or (viii) altering an amplitude ratio between a DC voltage applied to the quadrupole device and the main drive voltage.

The control system may be configured to operate the quadrupole device in the first mode of operation by operating the quadrupole device in a normal mode of operation wherein a main drive voltage is applied to the quadrupole device; and to operate the quadrupole device in the second mode of operation by operating the quadrupole device in an X-band or Y-band mode of operation wherein a main drive voltage and two or more auxiliary drive voltages are applied to the quadrupole device.

The control system may be configured to alter the resolution of the quadrupole device by altering the amplitudes of the two or more auxiliary drive voltages.

The control system may be configured to operate the quadrupole device in the first mode of operation by operating the quadrupole device in a first X-band or Y-band mode of operation wherein a main drive voltage and two or more auxiliary drive voltages are applied to the quadrupole device; and to operate the quadrupole device in the second mode of operation by operating the quadrupole device in a second different X-band or Y-band mode of operation wherein a main drive voltage and two or more auxiliary drive voltages are applied to the quadrupole device.

In the first X-band or Y-band mode of operation the two or more auxiliary drive voltages may comprise a particular auxiliary drive voltage pair type.

In the second different X-band or Y-band mode of operation the two or more auxiliary drive voltages may comprise a different auxiliary drive voltage pair type.

The control system may be configured to operate the quadrupole device in the first mode of operation by operating the quadrupole device in a Y-band mode of operation wherein a main drive voltage and two or more auxiliary drive voltages are applied to the quadrupole device; and to operate the quadrupole device in the second mode of operation by operating the quadrupole device in an X-band mode of operation wherein a main drive voltage and two or more auxiliary drive voltages are applied to the quadrupole device.

The two or more auxiliary drive voltages may comprise a first auxiliary drive voltage having a first amplitude $V_{ex1}$ and a second auxiliary drive voltage having a second amplitude $V_{ex2}$.

The control system may be configured to alter the resolution of the quadrupole device by altering an amplitude ratio between two or more of the auxiliary drive voltages.

In the first and/or second X-band or Y-band mode of operation:

each of the two or more auxiliary drive voltages may have a different frequency to the main drive voltage; and/or the two or more auxiliary drive voltages may comprise two or more auxiliary drive voltages having at least two different frequencies.

In the first and/or second X-band or Y-band mode of operation:

the main drive voltage may have a main drive voltage frequency $\Omega$; and the two or more auxiliary drive voltages may comprise a first auxiliary drive voltage having a first frequency $\omega_{ex1}$ and a second auxiliary drive voltage having a second different frequency $\omega_{ex2}$, wherein the main drive voltage frequency $\Omega$ and the first and second frequencies $\omega_{ex1}$, $\omega_{ex2}$ may be related by $\omega_{ex1}=v_1\Omega$, and $\omega_{ex2}=v_2\Omega$, where $v_1$ and $v_2$ are constants.

In the first and/or second X-band or Y-band mode of operation:

the first and second auxiliary drive voltages may comprise (i) a first auxiliary drive voltage pair type, wherein $v_1=v$ and $v_2=1-v$; (ii) a second auxiliary drive voltage pair type, wherein $v_1=v$ and $v_2=1+v$; (iii) a third auxiliary drive voltage pair type, wherein $v_1=1-v$ and $v_2=2-v$; (iv) a fourth auxiliary drive voltage pair type, wherein $v_1=1-v$ and $v_2=2+v$; (v) a fifth auxiliary drive voltage pair type, wherein $v_1=1+v$ and $v_2=2-v$; or (vi) a sixth auxiliary drive voltage pair type, wherein $v_1=1+v$ and $v_2=2+v$.

In the first and/or second X-band or Y-band mode of operation:

the two or more auxiliary drive voltages may comprise a first auxiliary drive voltage having a first amplitude $V_{ex1}$, and a second auxiliary drive voltage having a second different amplitude $V_{ex2}$, wherein the absolute value of the ratio of the second amplitude to the first amplitude $V_{ex2}/V_{ex1}$ may be in the range 1-10.

The main drive voltage and/or the two or more auxiliary drive voltages may comprise digital drive voltages.

The control system may be configured to operate the quadrupole device using two or more calibration curves.

The control system may be configured to operate the quadrupole device in the first mode of operation using a first calibration function.

The control system may be configured to operate the quadrupole device in the second mode of operation using a second different calibration function.

According to an aspect there is provided apparatus comprising:

a quadrupole device; and a control system;

wherein the control system is configured:

(i) to operate the quadrupole device in a first mode of operation, wherein ions within a first mass to charge ratio range are selected and/or transmitted by the quadrupole device; and (ii) to operate the quadrupole device in a second mode of operation, wherein ions within a second different mass to charge ratio range are selected and/or transmitted by the quadrupole device;

wherein the control system is configured to operate the quadrupole device in the first mode of operation by operating the quadrupole device using a first calibration function; and wherein the control system is configured to operate the quadrupole device in the second mode of operation by operating the quadrupole device using a second different calibration function.

According to an aspect there is provided a mass and/or ion mobility spectrometer comprising apparatus as described above.

BRIEF DESCRIPTION OF THE DRAWINGS

Various embodiments will now be described, by way of example only, and with reference to the accompanying drawings in which.

DETAILED DESCRIPTION

Various embodiments are directed to a method of operating a quadrupole device such as a quadrupole mass filter.

Figure 1:
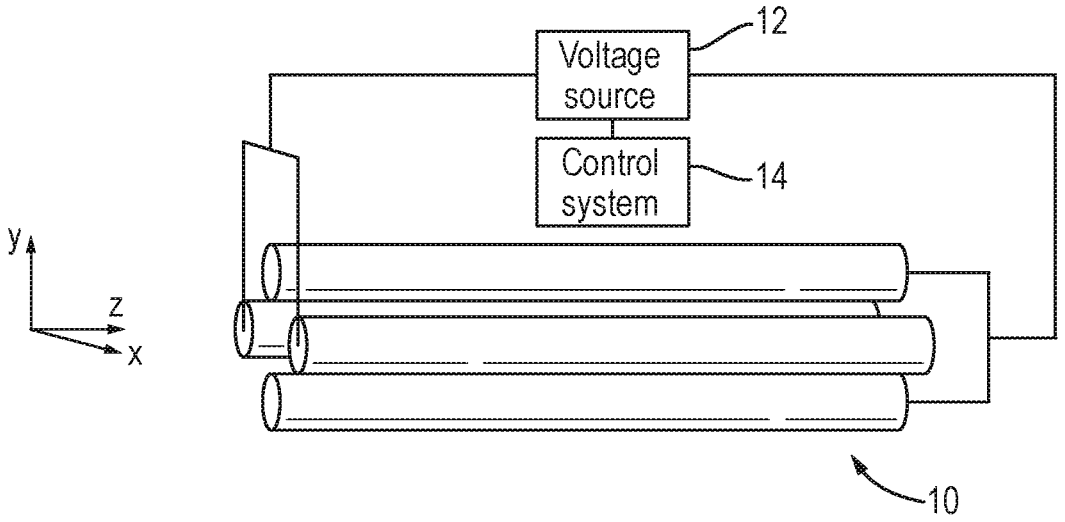
FIG. 1 shows schematically a quadrupole mass filter in accordance with various embodiments.

As illustrated schematically in FIG. 1, the quadrupole device 10 may comprise a plurality of electrodes such as four electrodes, e.g. rod electrodes, which may be arranged to be parallel to one another. The quadrupole device may comprise any suitable number of other electrodes (not shown).

The rod electrodes may be arranged so as to surround a central (longitudinal) axis of the quadrupole (z-axis) (i.e. that extends in an axial (z) direction) and to be parallel to the axis (parallel to the axial- or z-direction).

Each rod electrode may be relatively extended in the axial (z) direction. Plural or all of the rod electrodes may have the same length (in the axial (z) direction). The length of one or more or each of the rod electrodes may have any suitable value, such as for example (i) <100 mm; (ii) 100-120 mm; (iii) 120-140 mm; (iv) 140-160 mm; (v) 160-180 mm; (vi) 180-200 mm; or (vii) >200 mm.

Each of the plural extended electrodes may be offset in the radial (r) direction (where the radial direction (r) is orthogonal to the axial (z) direction) from the central axis of the ion guide by the same radial distance (the inscribed radius) $r_0$, but may have different angular (azimuthal) displacements (with respect to the central axis) (where the angular direction (θ) is orthogonal to the axial (z) direction and the radial (r) direction). The quadrupole inscribed radius $r_0$ may have any suitable value, such as for example (i)<3 mm; (ii) 3-4 mm; (iii) 4-5 mm; (iv) 5-6 mm; (v) 6-7 mm; (vi) 7-8 mm; (vii) 8-9 mm; (viii) 9-10 mm; or (ix) >10 mm.

Each of the plural extended electrodes may be equally spaced apart in the angular (θ) direction. As such, the electrodes may be arranged in a rotationally symmetric manner around the central axis. Each extended electrode may be arranged to be opposed to another of the extended electrodes in the radial direction. That is, for each electrode that is arranged at a particular angular displacement $\theta_n$ with respect to the central axis of the ion guide, another of the electrodes is arranged at an angular displacement $\theta_n \pm 180°$.

Thus, the quadrupole device 10 (e.g. quadrupole mass filter) may comprise a first pair of opposing rod electrodes both placed parallel to the central axis in a first (x) plane, and a second pair of opposing rod electrodes both placed parallel to the central axis in a second (y) plane perpendicularly intersecting the first (x) plane at the central axis.

The quadrupole device may be configured (in operation) such that at least some ions are confined within the ion guide in a radial (r) direction (where the radial direction is orthogonal to, and extends outwardly from, the axial direction). At least some ions may be radially confined substantially along (in close proximity to) the central axis. In use, at least some ions may travel though the ion guide substantially along (in close proximity to) the central axis.

As will be described in more detail below, in various embodiments (in operation) plural different voltages are applied to the electrodes of the quadrupole device 10, e.g. by one or more voltage sources 12. One or more or each of the one or more voltage sources 12 may comprise an analogue voltage source and/or a digital voltage source.

As shown in FIG. 1, according to various embodiments, a control system 14 may be provided. The one or more voltage sources 12 may be controlled by the control system 14 and/or may form part of the control system 12. The control system may be configured to control the operation of the quadrupole 10 and/or voltage source(s) 12, e.g. in the manner of the various embodiments described herein. The control system 14 may comprise suitable control circuitry that is configured to cause the quadrupole 10 and/or voltage source(s) 12 to operate in the manner of the various embodiments described herein. The control system may also comprise suitable processing circuitry configured to perform any one or more or all of the necessary processing and/or post-processing operations in respect of the various embodiments described herein.

As shown in FIG. 1, each pair of opposing electrodes of the quadrupole device 10 may be electrically connected and/or may be provided with the same voltage(s). A first phase of one or more or each (RF or AC) drive voltage may be applied to one of the pairs of opposing electrodes, and the opposite phase of that voltage (180° out of phase) may be applied to the other pair of electrodes. Additionally or alternatively, one or more or each (RF or AC) drive voltage may be applied to only one of the pairs of opposing electrodes. In addition, a DC potential difference may be applied between the two pairs of opposing electrodes, e.g. by applying one or more DC voltages to one or both of the pairs of electrodes.

Thus, the one or more voltage sources 12 may comprise one or more (RF or AC) drive voltage sources that may each be configured to provide one or more (RF or AC) drive voltages between the two pairs of opposing rod electrodes. In addition, the one or more voltage sources 12 may comprise one or more DC voltage sources that may be configured to supply a DC potential difference between the two pairs of opposing rod electrodes.

The plural voltages that are applied to (the electrodes of) the quadrupole device 10 may be selected such that ions within (e.g. travelling through) the quadrupole device 10 having a desired mass to charge ratio or having mass to charge ratios within a desired mass to charge ratio range will assume stable trajectories (i.e. will be radially or otherwise confined) within the quadrupole device 10, and will therefore be retained within the device and/or onwardly transmitted by the device. Ions having mass to charge ratio values other than the desired mass to charge ratio or outside of the desired mass to charge ratio range may assume unstable trajectories in the quadrupole device 10, and may therefore be lost and/or substantially attenuated. Thus, the plural voltages that are applied to the quadrupole device 10 may be configured to cause ions within the quadrupole device 10 to be selected and/or filtered according to their mass to charge ratio.

As described above, in conventional operation, mass or mass to charge ratio selection and/or filtering is achieved by applying a single RF voltage and a resolving DC voltage to the electrodes of the quadrupole device 10.

As also described above, the addition of two quadrupolar or parametric excitations $\omega_{ex1}$ and $\omega_{ex2}$ (of a particular form) (i.e. in addition to the (main) RF voltage and the resolving DC voltage) can produce a stability region near the tip of the stability diagram (in a, q dimensions) characterized in that instability at the upper and lower mass to charge ratio (m/z) boundaries of the stability region is in a single direction (e.g. in the x or y direction).

In particular, with an appropriate selection of the excitation frequencies $\omega_{ex1}$, $\omega_{ex2}$ and amplitudes $V_{ex1}$, $V_{ex2}$ of the two additional AC excitations, the influence of the two excitations can be mutually cancelled for ion motion in either the x or y direction, and a narrow and long band of stability can be created along the boundary near the top of the first stability region (the so-called "X-band" or "Y-band").

For operation of the quadrupole device 10 in the X-band mode, the total applied potential V(t) can be expressed as:

$$V(t)=U+V_{RF}\cos(\Omega t)+V_{ex1}\cos(\omega_{ex1}t+\alpha_{ex1})-V_{ex2}\cos(\omega_{ex2}t+\alpha_{ex2}),$$

where U is the amplitude of the applied resolving DC potential, $V_{RF}$ is the amplitude of the main RF waveform, Ω is the frequency of the main RF waveform, $V_{ex1}$ and $V_{ex2}$ are the amplitudes of the first and second auxiliary waveforms, $\omega_{ex1}$ and $\omega_{ex2}$ are the frequencies of the first and second auxiliary waveforms, and $\alpha_{ex1}$ and $\alpha_{ex2}$ are the initial phases of the two auxiliary waveforms with respect to the phase of the main RF voltage. The amplitudes of the main RF and auxiliary voltages ($V_{RF}$, $V_{ex1}$ and $V_{ex2}$) are defined as positive for positive values of q (and negative for negative values of q).

The dimensionless parameters for the nth auxiliary waveform, $q_{ex(n)}$, a, and q may be defined as:

$$q_{ex(n)}=\frac{4eV_{ex(n)}}{M\Omega^2 r_{0^2}},$$

$$a=\frac{8eU}{M\Omega^2 r_{0^2}}, \text{ and}$$

$$q=\frac{4eV_{RF}}{M\Omega^2 r_{0^2}},$$

where M is the ion mass and e is its charge.

The phase offsets of the auxiliary waveforms $\alpha_{ex1}$ and $\alpha_{ex2}$ may be related to each other by:

$$\alpha_{ex2}=2\pi-\alpha_{ex1}.$$

Hence, the two auxiliary waveforms may be phase coherent (or phase locked), but free to vary in phase with respect to the main RF voltage.

The frequencies of the two parametric excitations $\omega_{ex1}$ and $\omega_{ex2}$ can be expressed as a fraction of the main confining RF frequency Ω in terms of a dimensionless base frequency v:

$$\omega_{ex1}=\nu_1\Omega, \text{ and } \Omega_{ex2}=\nu_2\Omega.$$

Examples of possible excitation frequencies and relative excitation amplitudes ($q_{ex2}/q_{ex1}$) for X-band operation are shown in Table 1. The base frequency v is typically between 0 and 0.1. The optimum value of the ratio $q_{ex2}/q_{ex1}$ depends on the magnitude of $q_{ex1}$ and $q_{ex2}$ and the value of the base frequency v, and is therefore not fixed.

TABLE 1

| | I | II | III | IV | V | VI |
|---|---|---|---|---|---|---|
| $v_1$ | v | v | 1 − v | 1 − v | 1 + v | 1 + v |
| $v_2$ | 1 − v | v + 1 | 2 − v | 2 + v | 2 − v | 2 + v |
| $q_{ex2}/q_{ex1}$ | ~2.9 | ~3.1 | ~7.1 | ~9.1 | ~6.9 | ~8.3 |

The optimum ratio of the amplitudes of the two additional excitation voltages, expressed as the ratio of the dimensional parameters $q_{ex1}$ and $q_{ex2}$ (in Table 1), is dependent on the excitation frequencies chosen. Increasing or decreasing the amplitude of excitation while maintaining the optimum amplitude ratio results in narrowing or widening of the stability band and hence increases or decreases the mass resolution of the quadrupole device 10.

Although operation of the quadrupole device 10 in the X-band mode has a number of advantages (as described above), the Applicants have recognised that further improvements can be made.

Typically, quadrupole mass filters are operated with a constant full width at half maximum (FWHM) across the mass to charge ratio (m/z) range, i.e. rather than with a constant resolution. Whilst operating a quadrupole in X-band mode allows greater resolution to be achieved (e.g. compared to the "normal" mode), the transmission/peak width characteristics of the quadrupole are not significantly improved, e.g. for thermalised ions.

Figure 2:
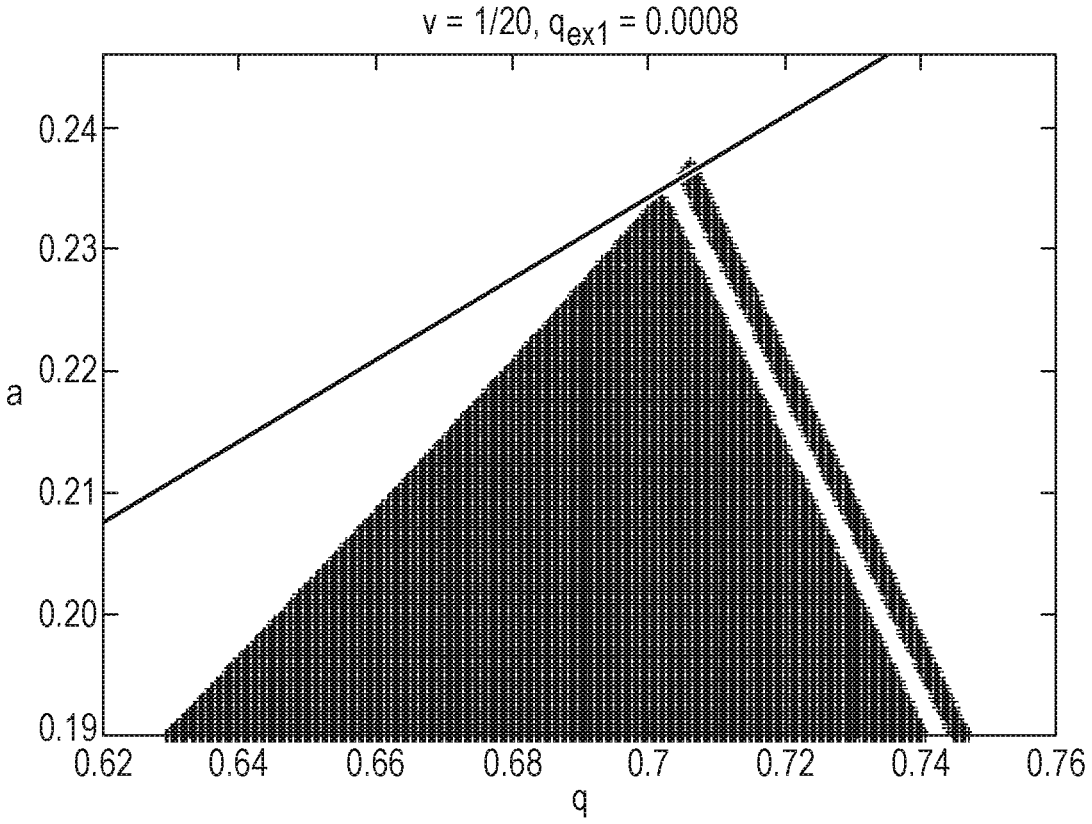
FIG. 2 shows a stability diagram for a quadrupole mass filter operating in an X-band mode of operation, where $v=1/20$, $v_1=v$, $v_2=(1-v)$, $q_{ex1}=0.0008$, and $q_{ex2}/q_{ex1}=2.915$.

FIG. 2 shows simulated data for the tip of the stability diagram (in a, q space) for X-band operation of the quadrupole device 10. For this model (and all simulated data herein) the following parameters were used: quadrupole inscribed radius $r_0$=5.33 mm, main RF frequency Ω=1 MHz, quadrupole length z=130 mm. In addition, X-band waveforms of the type $v_1$=v, and $v_2$=(1−v) (i.e. Type I in Table 1) were used.

In the example of FIG. 2, v=1/20, $v_1$=v, $v_2$=(1−v), $q_{ext1}$=0.0008, and $q_{ext2}/q_{ext1}$=2.915. The operating line, i.e. where the ratio a/q is constant, is shown intersecting the X-band.

The resolution of the mass filter is dictated by the width of the X-band stability region where it intersects the operating line. For the purposes of discussion herein, the resolving power R of the quadrupole mass filter 10 may be defined in terms of the ratio of the value of q at the centre of the X-band where it crosses the operating line $q_{centre}$, and the difference in the value of q (Δq) from one side of the X-band to the other at this position:

$$\Delta q = q_{max} - q_{min},$$

$$q_{centre} = \frac{q_{max} - q_{min}}{2}, \text{ and}$$

$$R = \frac{q_{centre}}{\Delta q}.$$

In FIG. 2, Δq=2e$^{-3}$, $q_{centre}$=0.705, and R=350.

Figure 3:
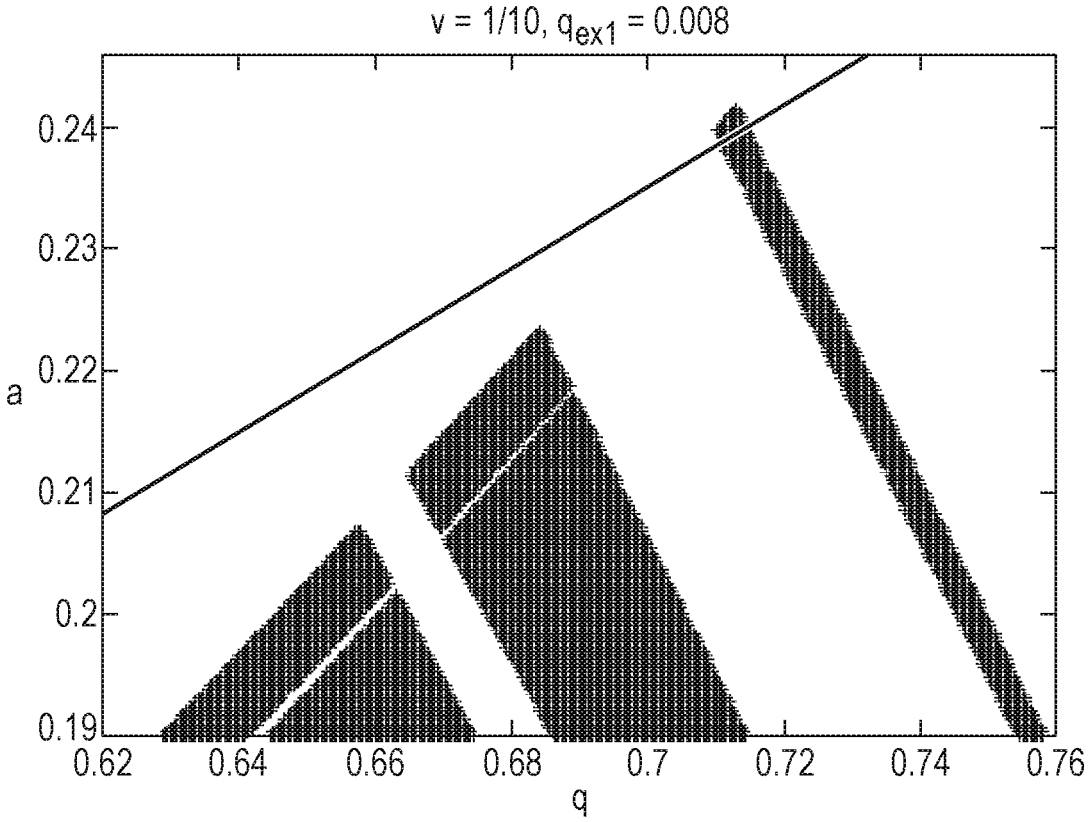
FIG. 3 shows a stability diagram for a quadrupole mass filter operating in an X-band mode of operation, where $v=1/10$, $v_1=v$, $v_2=(1-v)$, $q_{ex1}=0.008$, and $q_{ex2}/q_{ex1}=2.69$.

FIG. 3 shows the tip of the stability diagram (in a, q space) for X-band operation where v=1/10, $v_1$=v, $v_2$=(1−v), $q_{ext1}$=0.008 and $g_{ext2}/q_{ext1}$=2.69. In FIG. 3, Δq=3.6e$^{-3}$, $q_{centre}$=0.711, and R=200.

It can be seen that in the arrangement of FIG. 3 the value of $q_{ex1}$ is an order of magnitude higher than for the arrangement of FIG. 2. Therefore the excitation waveforms used in FIG. 3 are ten times greater in magnitude than in FIG. 2. Nevertheless, the resolution is lower for the configuration described with respect to FIG. 3 than it is for FIG. 2, i.e. despite a higher amplitude excitation waveform. This illustrates that to maintain a particular mass resolution with a higher value of the base frequency v in X-band operation, a much higher excitation amplitude must be applied.

Another observation is that the band of instability below the X-band (at lower values of q) is much narrower for v=1/20 (FIG. 2) than for v=1/10 (FIG. 3). As such, in FIG. 2 (i.e. for v=1/20), the resolution can only be lowered by a small amount (making the X-band wider) before the X-band ceases to exist. In contrast, in the arrangement of FIG. 3 (i.e. for v=1/10), the resolution may be lowered further without compromising X-band operation.

As such, at higher values of the base frequency v, lower resolution is achievable whilst maintaining X-band operation, compared to operation at lower values of the base frequency v. On the other hand, the amplitude of the auxiliary waveforms required to achieve a given resolution increases with increasing values of the base frequency v.

Figure 4:
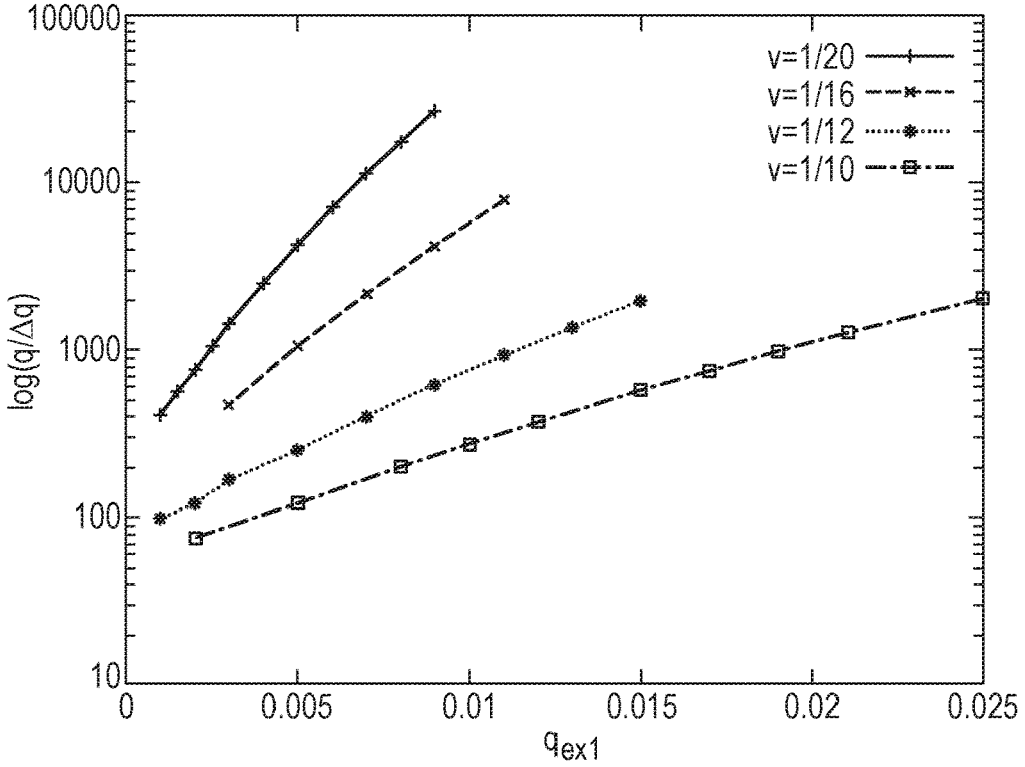
FIG. 4 shows a plot of $\log(q/\Delta q)$ versus $q_{ex1}$ for a quadrupole mass filter operating in an X-band mode of operation for four different values of base frequency v.

FIG. 4 shows a plot of log q/Δq versus $q_{ex1}$ for four different values of v (1/20, 1/16, 1/12 and 1/10). As can be seen from FIG. 4, there is a large difference in the amplitude of excitation required to maintain the same resolution as the value of the base frequency v is increased. Lower values of the base frequency v require lower excitation amplitudes to achieve the same resolution.

On the other hand, at low mass to charge ratio (m/z), excitation with low values of the base frequency v (i.e. and therefore operation of the quadrupole device 10 with high resolution) can lead to transmission losses.

Figure 5:
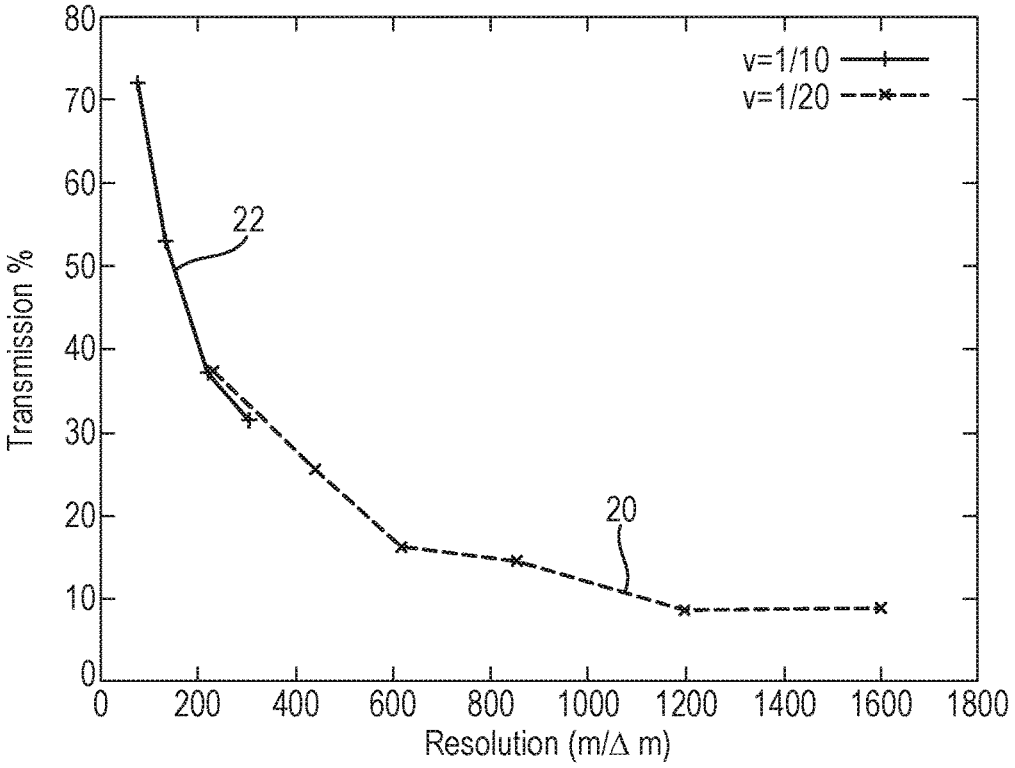
FIG. 5 shows a plot of transmission versus resolution for ions having a mass to charge ratio of 50 passing through a quadrupole mass filter operating in an X-band mode of operation for two different values of base frequency v.
Figure 6A:
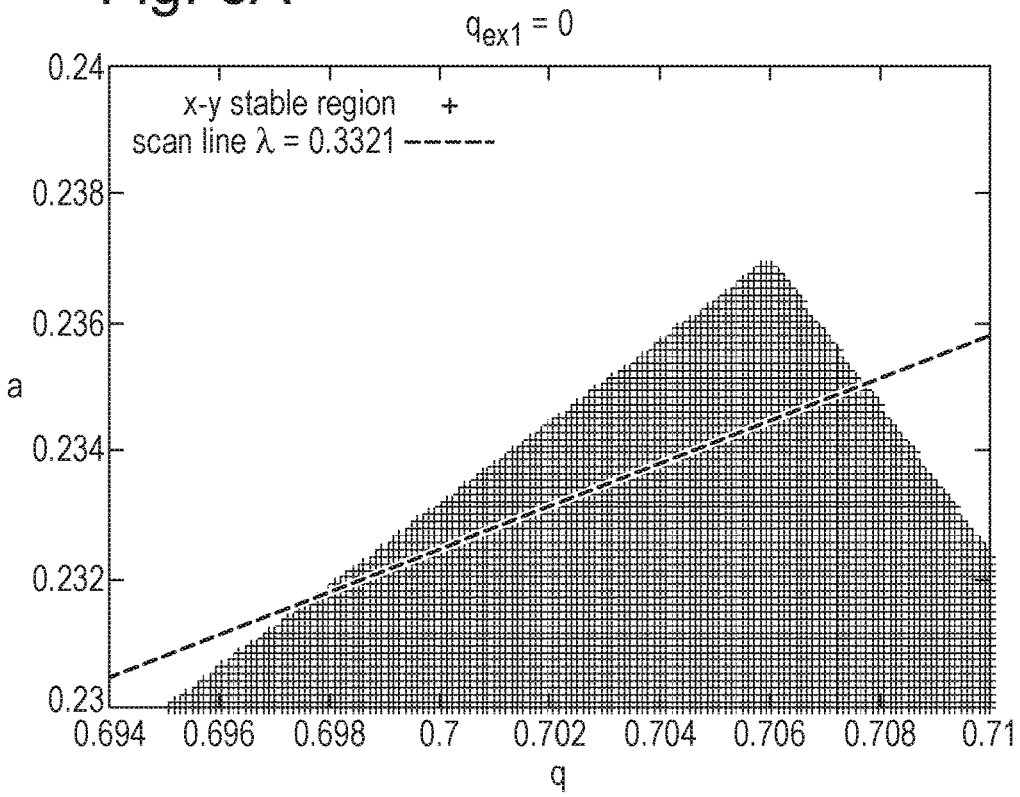
FIG. 6 shows a stability diagram and a simulated peak for a quadrupole mass filter operating in a normal mode of operation.
Figure 6B:
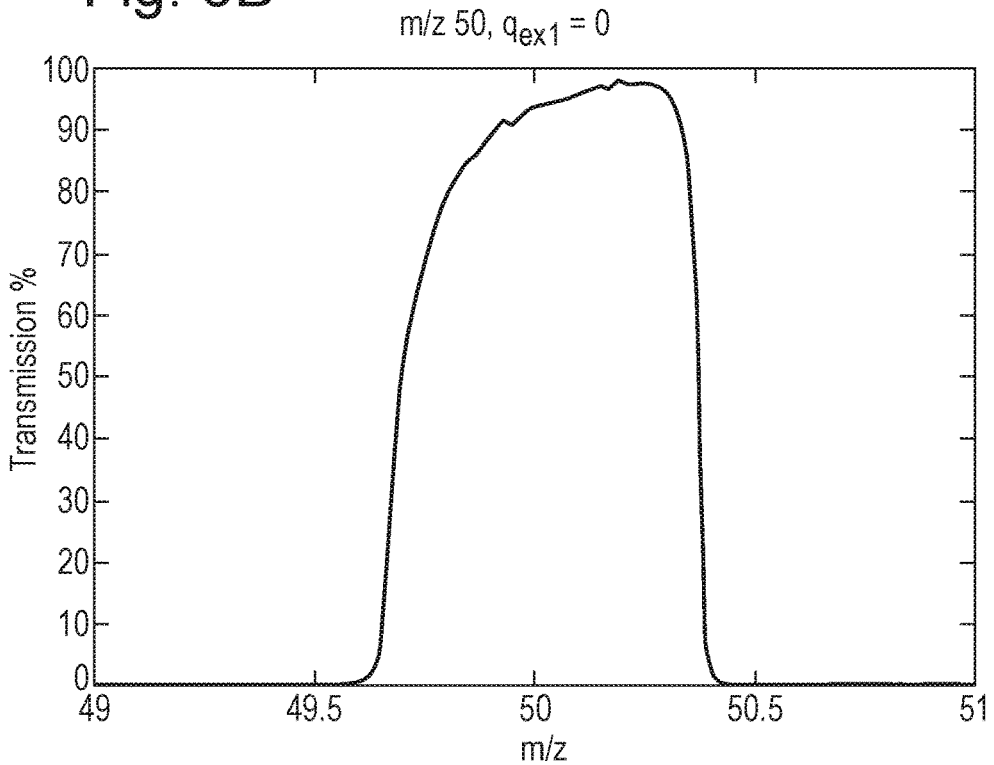

FIG. 5 shows a plot of transmission (%) versus resolution for ions having a mass to charge ratio (m/z) of 50. Plot 20 shows the transmission resolution characteristic for X-band operation with excitation base frequency v=1/20. Using this excitation frequency it is not possible to maintain X-band operation with a resolution below 200 (peak width >0.25 Da). The transmission at this resolution is less than 40%.

Plot 22 shows the transmission resolution characteristic for X-band operation with excitation base frequency v=1/10. Using this excitation frequency the resolution may be adjusted to 70 (peak width 0.7 Da) at >70% transmission.

It will accordingly be appreciated that relatively low values of the base frequency v can be used to obtain relatively high resolution. However, since for relatively low values of base frequency v, the band of instability below the X-band is relatively small, it is not possible to use relatively low values of base frequency v to obtain a relatively low resolution. At higher amplitudes the working point of the X-band, in (a, q) coordinates, shifts to higher a and q values, reducing the effective mass to charge ratio (m/z) range of the quadrupole for a given maximum main RF voltage.

In contrast, relatively high values of base frequency v can be used to obtain relatively low resolution. However, for relatively high values of base frequency v, in order to obtain a relatively high resolution, very large excitation amplitudes must be used, which can be impractical and expensive to implement. In other words, using this waveform at higher mass to charge ratio (m/z) requires higher and higher excitation amplitudes which can become impractical in terms of the power requirements of the electronics.

Thus, in X-band mode (using a given base frequency v), where it is desired to maintain a constant FWHM over a relatively large mass to charge ratio (m/z) range, it can be difficult to obtain low enough resolution at low mass to charge ratio (m/z) to attain the desired FWHM, whilst also being able to provide enough amplitude for the auxiliary RF or AC voltages to achieve the required FWHM at high mass to charge ratio (m/z), i.e. the amplitude requirements to achieve resolution at high mass to charge ratio (m/z) become difficult to implement.

Furthermore, for a given mass resolution, it can be shown that transmission decreases when using higher values of base frequency v, and consequently higher excitation voltage amplitudes. Therefore it is not possible to optimize the transmission versus resolution characteristics of the mass filter for all mass to charge ratio (m/z) values when operating using a single base frequency v in X-band mode.

Various embodiments are directed to a method in which the quadrupole device 10 (e.g. quadrupole mass filter) is operated in a first mode of operation when selecting and/or transmitting ions within a first mass to charge ratio range, and is operated in a second different mode of operation when selecting and/or transmitting ions within a second different mass to charge ratio range.

As described in more detail below, by configuring the quadrupole device to be operable in different modes of operation for different mass to charge ratio ranges, the most suitable and beneficial mode of operation can be selected and used for a given mass to charge ratio range. Thus, for example, where it is desired to use a relatively high resolution mode of operation, e.g. for relatively high mass to charge ratio ions, then a relatively high resolution X-band or Y-band mode of operation may be used. Where it is desired to use a relatively low resolution mode of operation, e.g. for relatively low mass to charge ratio ions, then the normal mode of operation may be used or a relatively low resolution X-band or Y-band mode of operation may be used.

Thus, for example, according to various embodiments (as described in more detail below) at low mass to charge ratio (m/z) values, excitations with higher values of base frequency v may be used. At higher mass to charge ratio (m/z) values, auxiliary waveforms with lower values of v and consequently lower amplitudes may be used. In these embodiments, the base frequency v of the X-band excitations may be switched, e.g. discontinuously, at a suitable mass to charge ratio (m/z) value.

However, as described in more detail below, if this transition were made during a scan (i.e. while scanning the set mass of the quadrupole device continuously), this would mean that the position of the X-band would change abruptly at the transition point, causing the mass to charge ratio (m/z) scale to be discontinuous. This would make mass to charge ratio (m/z) calibration difficult or impossible in a scanning mode of operation. In addition, the transition between one base frequency v and another is not "smooth" and would require abrupt (discontinuous) changes to the applied amplitudes and frequencies during a scan.

Thus, various further embodiments relate to a method in which X-band operation is introduced (or removed), e.g. as the mass to charge ratio (m/z) (set mass) of the quadrupole device 10 is scanned, altered and/or varied (e.g. increased or decreased). This may be done by transitioning between "normal" quadrupole operation and X-band operation (and/or vice versa). This may be done discontinuously, but according to various particular embodiments this is done continuously, e.g. smoothly as the mass to charge ratio (m/z) (set mass) of the quadrupole device 10 is scanned.

According to various particular embodiments, the quadrupole device 10 is operated at the tip of the stability diagram (i.e. conventionally) initially, the auxiliary RF or AC voltages are increased until X-band is achieved at a suitable resolution, and then the quadrupole device 10 is operated in X-band mode.

According to various embodiments, while the quadrupole device 10 is operated in X-band mode, the device's resolution is changed, e.g. as the set mass or mass to charge ratio (m/z) is altered or scanned. This may be done so as to maintain a constant FWHM (peak width) across the mass to charge ratio range, e.g. so that the transmission of low mass to charge ratio peaks is maintained.

In this regard, the Applicants have recognised that the desired performance characteristics of a quadrupole device are relatively straightforward to attain at relatively low mass to charge ratios (m/z) (namely transmission/resolution performance, fast scan performance, etc.) using the "normal" mode of operation, i.e. due to the lower resolution requirements. Most of the benefits of operating the quadrupole device 10 in X-band mode are therefore not required for low mass to charge ratio (m/z) ions when operated at such low resolution.

In contrast, the benefits of operating the quadrupole device 10 in X-band mode are particularly useful at relatively high mass to charge ratios (m/z).

Thus, in accordance with various embodiments, when altering or scanning the set mass of the quadrupole mass filter, the quadrupole mass filter is operated in the normal mode at relatively low mass to charge ratios, and is operated in the X-band mode at relatively high mass to charge ratios.

This means that the base frequency v of the auxiliary RF or AC voltages for the X-band mode can be selected such that a sufficiently high resolution can be obtained at the top of the mass to charge ratio range without requiring prohibitively high auxiliary voltage amplitudes. In accordance with various embodiments, rather than using this X-band mode at the bottom of the mass to charge ratio range (which as described above may not be capable of providing the desired resolution), the normal mode of operation is instead used.

Furthermore, by gradually introducing the X-band auxiliary RF or AC voltages as the set mass of the quadrupole mass filter 10 is increased (or vice versa), a constant FWHM (peak width) can be maintained across the mass to charge ratio range. Moreover, this can be done without abrupt changes to the stability diagram, and so without causing mass to charge ratio (m/z) discontinuities.

It will also be appreciated that for different scan types of the quadrupole device 10, the resolution requirements may differ. Thus, according to various embodiments, the X-band mode is used only when its characteristics are required.

It will accordingly be appreciated that various embodiments provide an improved quadrupole device.

As described above, in various embodiments, the quadrupole device 10 is operated in a first mode of operation when selecting and/or transmitting ions within a first mass to charge ratio range, and is operated in a second mode of operation when selecting and/or transmitting ions within a second different mass to charge ratio range. The first mode of operation can be a normal mode of operation (wherein a main drive voltage is applied to the quadrupole device), or an X-band or Y-band mode of operation (wherein a main drive voltage and two or more auxiliary drive voltages are applied to the quadrupole device). The second mode of operation can be an X-band or Y-band mode of operation (wherein a main drive voltage and two or more auxiliary drive voltages are applied to the quadrupole device).

According to various particular embodiments, the quadrupole device 10 may be operated in a normal mode of operation, e.g. for relatively low mass to charge ratios, and may be operated in an X-band (or Y-band) mode of operation, e.g. for relatively high mass to charge ratios.

Thus, the first mass to charge ratio range may be at least partially lower than the second mass to charge ratio range. That is, the first mass to charge ratio range may encompass lower mass to charge ratio values than the second mass to charge ratio range. The second mass to charge ratio range may be at least partially higher than the first mass to charge ratio range. That is, the second mass to charge ratio range may encompass higher mass to charge ratio values than the first mass to charge ratio range.

The first mass to charge ratio range may be partially lower than the second mass to charge ratio range (and the second mass to charge ratio range may be partially higher than the first mass to charge ratio range), that is, the first mass to charge ratio range may partially overlap with the second mass to charge ratio range; or the first mass to charge ratio range may be entirely lower than the second mass to charge ratio range (and the second mass to charge ratio range may be entirely higher than the first mass to charge ratio range), that is, the first mass to charge ratio range and the second mass to charge ratio range may be non-overlapping ranges.

In the normal mode of operation the plural different voltages that are (simultaneously) applied to the electrodes of the quadrupole device 10, e.g. by the one or more voltage sources 12, may comprise a main drive (e.g. RF or AC) voltage and optionally one or more DC voltages.

The main drive voltage (and the one or more DC voltages) may be selected as desired in order to achieve a desired set mass and resolution. Thus, the main drive voltage may have any suitable amplitude $V_{RF}$. The main drive voltage may have any suitable frequency Ω, such as for example (i)<0.5 MHz; (ii) 0.5-1 MHz; (iii) 1-2 MHz; (iv) 2-5 MHz; or (v) >5 MHz. The main drive voltage may comprises an RF or AC voltage, e.g. that takes the form $V_{RF}\cos(\Omega t)$.

Equally, each of the one or more DC voltages may have any suitable amplitude U.

The total applied potential for the normal mode of operation according to various embodiments may be defined as:

$$V(t)=U+V_{RF}\cos(\Omega t).$$

As described above, in the X-band (or Y-band) mode of operation, the plural different voltages that are (simultaneously) applied to the electrodes of the quadrupole device 10, e.g. by the one or more voltage sources 12, may comprise a main drive voltage, two (or more) auxiliary drive voltages and optionally one or more DC voltages.

The quadrupole device 10 can be operated in either the X-band mode or the Y-band mode, but operation in the X-band mode is particularly advantageous for mass filtering as it results in instability occurring in very few cycles of the main drive voltage, thereby providing several advantages including: fast mass separation, higher mass to charge ratio (m/z) resolution, tolerance to mechanical imperfections, tolerance to initial ion energy and surface charging due to contamination, and the possibility of miniaturizing or reducing the size of the quadrupole device 10.

Thus, the plural voltages may be configured (selected) so as to correspond to a Y-band stability condition, but according to various particular embodiments, the plural voltages are configured (selected) so as to correspond to an X-band stability condition. As described above, an X-band or Y-band stability condition can be generated by applying two quadrupolar parametric excitations with frequencies $\omega_{ex1}$ and $\omega_{ex2}$ (of a particular form) (i.e. in addition to the main drive voltage and where present the resolving DC voltage) to the quadrupole device 10.

Thus, according to various embodiments, two or more auxiliary drive voltages are applied to the quadrupole device 10 (i.e. in addition to the main drive voltage), e.g. comprising an X-band (or Y-band) pair of auxiliary drive voltages. Thus, the plural different voltages that are (simultaneously) applied to the electrodes of the quadrupole device 10 may comprise a main drive voltage, (optionally a resolving DC voltage), and two or more auxiliary drive voltages (i.e. a first and a second auxiliary drive voltage).

It would also be possible to apply more than two auxiliary drive voltages to the quadrupole device, if desired.

Each of the auxiliary drive voltages may comprises an RF or AC voltage, and e.g. may take the form $V_{exn}\cos(\omega_{exn}t+\alpha_{exn})$, where $V_{exn}$ is the amplitude of the nth auxiliary drive voltage, $\omega_{exn}$ is the frequency of the nth auxiliary drive voltage, and $\alpha_{exn}$ is an initial of phase the nth auxiliary waveform with respect to the phase of the main drive voltage.

As described above, the total applied potential for the X-band mode according to various embodiments may be defined as:

$$V(t)=U+V_{RF}\cos(\Omega t)+V_{ex1}\cos(\omega_{ex1}t+\alpha_{ex1})-V_{ex2}\cos(\omega_{ex2}t+\alpha_{ex2}).$$

The voltage amplitudes are all defined to be positive for positive values of q.

Following this notation and the known conventions for describing ion motion in an oscillating quadrupole field, the dimensionless parameters $q_{ex(n)}$, a and q may be defined as:

$$q_{ex(n)}=\frac{4eV_{ex(n)}}{M\Omega^2 r_{02}},$$

$$a=\frac{8eU}{M\Omega^2 r_{02}}, \text{ and}$$

$$q=\frac{4eV_{RF}}{M\Omega^2 r_{02}}.$$

The phase offsets for the pair of auxiliary waveforms may be related as described above, i.e.:

$$\alpha_{ex2}=2\pi-\alpha_{ex1}.$$

Hence, the pair of auxiliary waveforms may be phase coherent (phase locked), but may be free to vary in phase with respect to the main drive voltage.

Each of the auxiliary drive voltages may have any suitable amplitude $V_{exn}$, and any suitable frequency $\omega_{exn}$. At least two of the two or more auxiliary drive voltages may have different frequencies.

The frequencies and/or amplitudes of the two or more auxiliary drive voltages may correspond to the frequencies and/or amplitudes of an X-band or Y-band pair of auxiliary drive voltages, e.g. as described above.

Thus, the frequencies of the auxiliary drive voltages may be expressed as a fraction of the main confining drive frequency Ω in terms of two a dimensionless base frequency v:

$$\omega_{ex1}=v_1\Omega, \text{ and } \omega_{ex2}=v_2\Omega.$$

The relationship between the excitation frequencies $\omega_{exn}$ for the pair of auxiliary drive voltages may correspond to the relationship between the excitation frequencies $\omega_{exn}$ for an X-band pair of auxiliary drive voltages as described above (e.g. those given above in Table 1).

Equally, the relationship between the excitation amplitudes $q_{exn}$ for the pair of auxiliary drive voltages may correspond to the relationship between the excitation amplitudes $q_{exn}$ for an X-band pair of auxiliary drive voltages as described above (e.g. those given above in Table 1). Thus, the ratio $q_{ex2}/q_{ex1}$ (i.e. $V_{ex2}/V_{ex1}$) may be in the range 1-10.

According to various particular embodiments, the excitation frequencies and/or the relative excitation amplitudes ($q_{ex2}/q_{ex1}$) for the pair of auxiliary drive voltages may be selected from Table 2.

TABLE 2

| | I | II | III | IV | V | VI |
|---|---|---|---|---|---|---|
| $v_1$ | v | v | 1 − v | 1 − v | 1 + v | 1 + v |
| $v_2$ | 1 − v | v + 1 | 2 − v | 2 + v | 2 − v | 2 + v |
| $q_{ex2}/q_{ex1}$ | ~2.9 | ~3.1 | ~7.1 | ~9.1 | ~6.9 | ~8.3 |

The base frequency v may take any suitable value, such as for example (i) between 0 and 0.5; (ii) between 0 and 0.4;

(iii) between 0 and 0.3; and/or (iv) between 0 and 0.2. In various particular embodiments, the base frequency v is between 0 and 0.1.

The quadrupole device 10 may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation; a Quantification mode of operation; and/or an Ion Mobility Spectrometry ("IMS") mode of operation.

In various embodiments, the quadrupole device 10 may be operated in a varying mass resolving mode of operation, i.e. ions having more than one particular mass to charge ratio or more than one mass to charge ratio range may be selected and onwardly transmitted by the quadrupole mass filter.

For example, according to various embodiments, the set mass of the quadrupole device 10 may scanned, e.g. substantially continuously, e.g. so as to sequentially select and transmit ions having different mass to charge ratios or mass to charge ratio ranges. Additionally or alternatively, the set mass of the quadrupole device may altered discontinuously and/or discretely, e.g. between plural different values of mass to charge ratio (m/z).

In these embodiments, one or more or each of the various parameters of the plural voltages that are applied to the quadrupole device 10 (as described above) may be scanned, altered and/or varied, as appropriate.

In particular, in order to scan, alter and/or vary the set mass of the quadrupole device, the amplitude of the main drive voltage $V_{RF}$ and the amplitude of the DC voltage U may be scanned, altered and/or varied. The amplitude of the main drive voltage $V_{RF}$ and the amplitude of the DC voltage U may be increased or decreased in a continuous, discontinuous, discrete, linear, and/or non-linear manner, as appropriate. This may be done while maintaining the ratio of the main resolving DC voltage amplitude to the main RF voltage amplitude $\lambda=2U/V_{RF}$ constant or otherwise.

As described above, as transmission through the quadrupole device 10 is related to its resolution, it is often desirable to maintain a lower resolution at low mass to charge ratio (m/z) and higher resolution at higher mass to charge ratio (m/z). For example, it is common to operate a quadrupole mass filter with a fixed peak width (in Da) at each of the desired mass to charge ratio (m/z) values or over the desired mass to charge ratio (m/z) range.

Thus, according to various embodiments, the resolution of the quadrupole device 10 is scanned, altered and/or varied, e.g. over time. The resolution of the quadrupole device 10 may be varied in dependence on (i) mass to charge ratio (m/z) (e.g. the set mass of the quadrupole device); (ii) chromatographic retention time (RT) (e.g. of an eluent from which the ions are derived eluting from a chromatography device upstream of the quadrupole device); and/or (iii) ion mobility (IMS) drift time (e.g. of the ions as they pass through an ion mobility separator upstream or downstream of the quadrupole device 10).

The resolution of the quadrupole device 10 may be varied in any suitable manner. For example, one or more or each of the various parameters of the plural voltages that are applied to the quadrupole device 10 (as described above) may be scanned, altered and/or varied such that the resolution of the quadrupole device 10 is scanned, altered and/or varied.

In the normal, non-X-band, mode of operation, the $U/V_{RF}$ ratio may be adjusted to adjust the resolution of the quadrupole device 10. Thus, in order to operate the quadrupole mass filter with a substantially constant peak width in the normal, non-X-band, mode of operation, the $U/V_{RF}$ ratio may be adjusted, e.g. non-linearly, with mass to charge ratio (m/z), i.e. so as to maintain a constant peak width over the mass to charge ratio (m/z) range.

In these modes of operation, the position of the apex of the stability diagram in q may remain constant regardless of the peak width and mass to charge ratio (m/z) value. While the position of the centroid of the peak in q may change as the resolution is adjusted, this is a small and approximately first order effect, hence a good linear calibration can be obtained between mass to charge ratio (m/z) and $V_{RF}$.

In the X-band mode of operation, the main drive frequency Ω may be maintained constant, and the width (in units of q) of the X-band at the working point of the stability diagram may be adjusted to achieve the desired resolution (mass to charge ratio (m/z) band pass).

According to various embodiments, this may be done (i.e. the resolution may be altered) by altering the relative frequency between the pair of auxiliary drive voltages.

Additionally or alternatively, in the X-band mode of operation, the amplitude of the auxiliary excitations may be increased or decreased (e.g. while maintaining the amplitude ratio $q_{ex2}/q_{ex1}$ constant), i.e. so as to narrow or widen the stability band, and hence increase or decrease the mass resolution of the quadrupole device 10.

Thus, according to various particular embodiments, the amplitude $V_{exn}$ (or $q_{exn}$) of one or more or each of the auxiliary drive voltages is varied (increased or decreased) in order to vary (increase or decrease) the resolution of the quadrupole device 10. One or more or each of the amplitudes $V_{exn}$ ($q_{exn}$) may be increased or in a continuous, discontinuous, discrete, linear, and/or non-linear manner.

According to various embodiments, the values U, $V_{RF}$, $V_{ext1}$ and $V_{ext2}$ are adjusted simultaneously, e.g. to maintain a constant FWHM (peak width) across the mass to charge ratio (m/z) range (i.e. when using a pair of X-band auxiliary waveforms).

In these embodiments, the range over which the amplitudes $V_{exn}$ ($q_{exn}$) are varied may be selected as desired. One or more or each of the amplitudes $V_{exn}$ ($q_{exn}$) may, for example, be varied between zero and a particular, e.g. selected, maximum value, and/or one or more or each of the amplitudes $V_{exn}$ ($q_{exn}$) may be varied between a particular, e.g. selected, minimum (non-zero) value and a maximum value.

According to various embodiments, the quadrupole device 10 may be operated in the normal mode of operation, and may then be operated in the X-band (or Y-band) mode of operation, e.g. where a pair of auxiliary drive voltages is applied to the quadrupole device 10 together with the main drive voltage.

According to various embodiments, the quadrupole device 10 may be operated in the X-band (or Y-band) mode of operation (e.g. where a first pair of auxiliary drive voltages are applied to the quadrupole device 10), and may then be operated in the normal mode of operation, e.g. where the main drive voltage is applied to the quadrupole device 10.

In these embodiments, in the normal mode of operation the amplitudes of the pair of auxiliary drive voltages may be set to zero, and in the X-band (or Y-band) mode of operation, one or both of the amplitudes of the pair of auxiliary drive voltages may be varied (increased or decreased), e.g. as described above.

The amplitudes of the auxiliary waveforms may be adjusted (continuously or discontinuously) in dependence on (i) mass to charge ratio (m/z); and/or (ii) chromatographic retention time (RT); and/or (iii) ion mobility (IMS) drift time.

This may be done such that: (i) the transmission/resolution characteristics of the quadrupole device 10 (e.g. mass filter) are maintained at optimum values for each mass to charge ratio (m/z) value or range; and/or (ii) the power supply requirements are maintained within practical limits.

FIGS. 6-12 illustrate operation of the quadrupole device 10 in accordance with various embodiments. FIGS. 6A-12A show simulated data for the tip of the stability diagram (in a, q space) for various modes of operation, and FIGS. 6B-12B show corresponding simulated transmission data. For this model the following parameters were used: quadrupole inscribed radius r0=5.33 mm, main RF frequency Ω=1 MHz, quadrupole length z=130 mm. X-band waveforms of the type $v_1$=v, and $v_2$=(1−v) (i.e. Type I in Table 1), $q_{ex2}/q_{ex1}$~2.9 were used, where v=1/20.

FIG. 6 shows simulated data for normal operation, i.e. where no auxiliary drive voltages are applied to the quadrupole device 10, i.e. where $q_{ex1}$=0. Using a scan line for which the ratio of the main resolving DC voltage amplitude to the main RF voltage amplitude $\lambda=2U/V_{RF}=0.3321$ gives a FWHM of 0.65 Da for ions with a mass to charge ratio (m/z) of 50.

Figure 7A:
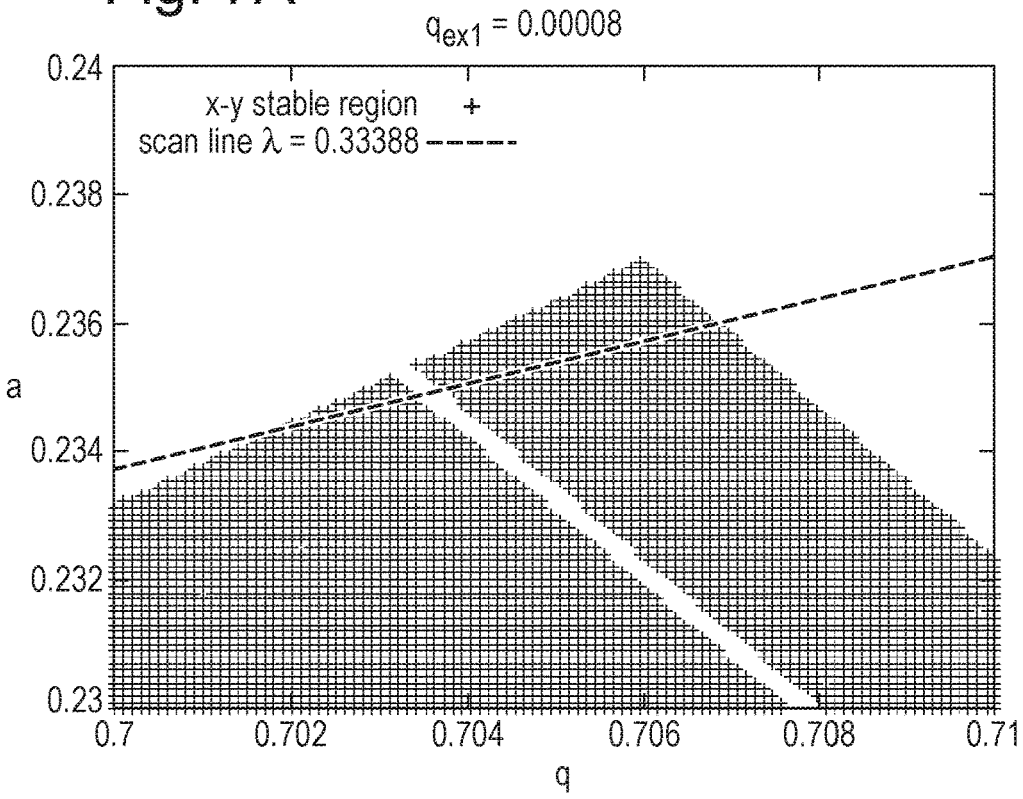
FIG. 7 shows a stability diagram and a simulated peak for a quadrupole mass filter operating in an X-band mode of operation, where $q_{ex1}$=0.00008.
Figure 7B:
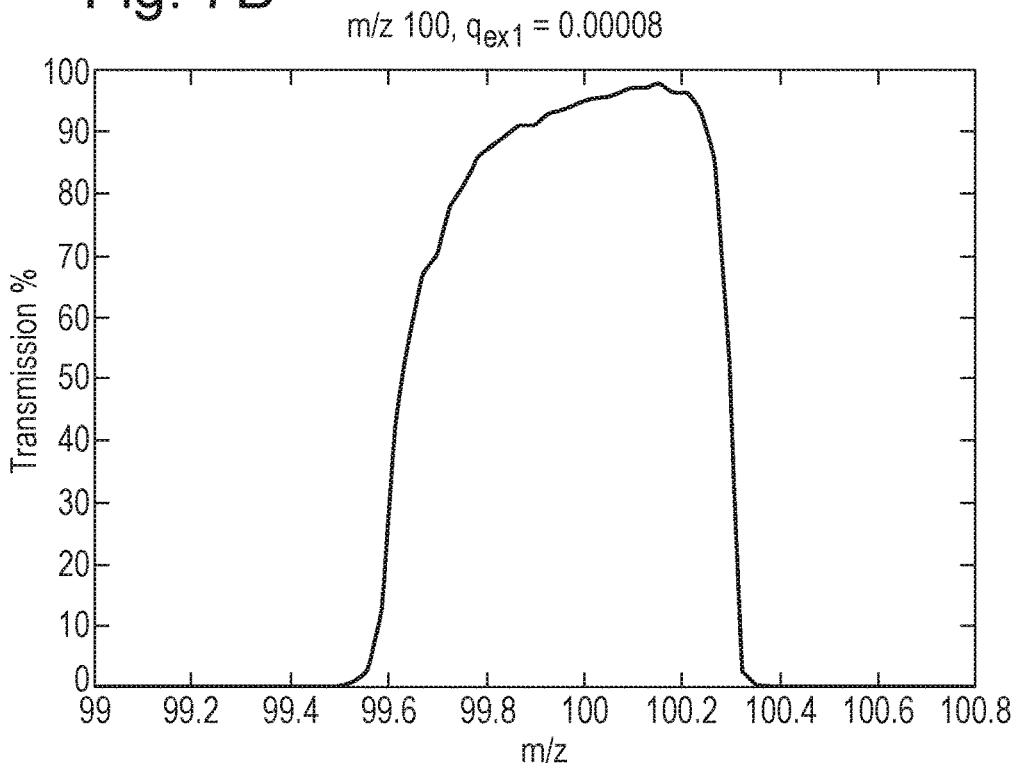

FIG. 7 shows simulated data for X-band operation where $q_{ex1}$=0.00008. Using a scan line for which $\lambda=2U/V_{RF}=0.33388$ gives a FWHM of 0.65 Da for ions with a mass to charge ratio (m/z) of 100.

Figure 8A:
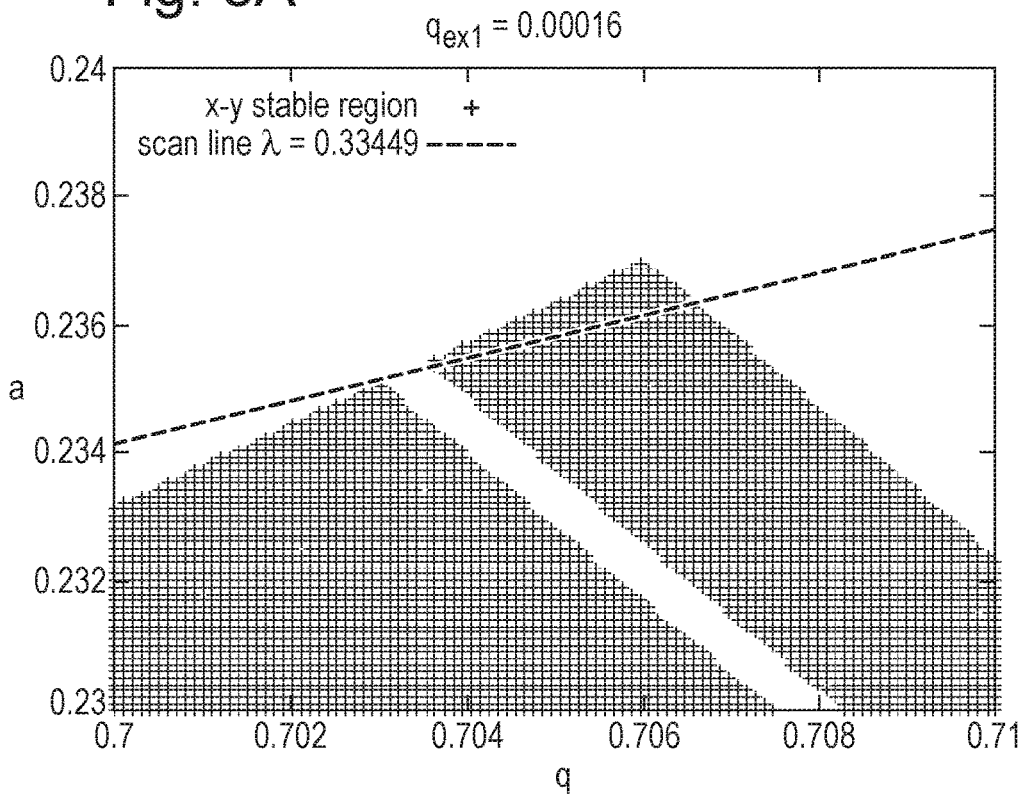
FIG. 8 shows a stability diagram and a simulated peak for a quadrupole mass filter operating in an X-band mode of operation, where $q_{ex1}$=0.00016.
Figure 8B:
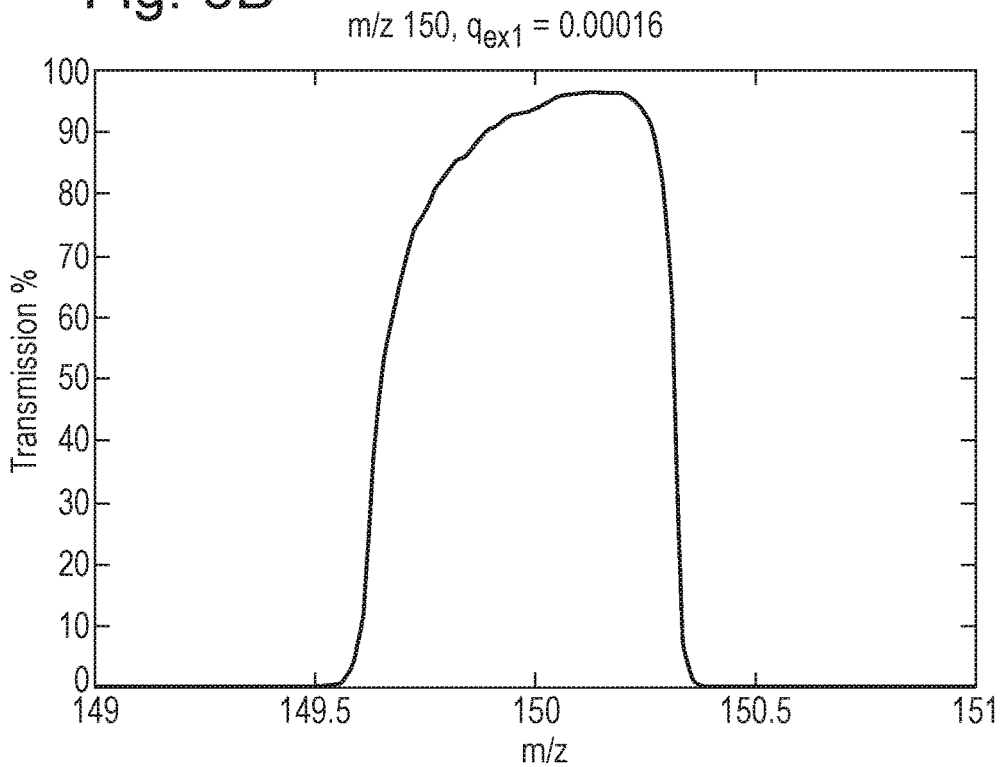

FIG. 8 shows simulated data for X-band operation where $q_{ex1}$=0.00016. Using a scan line for which $\lambda=2U/V_{RF}=0.33449$ gives a FWHM of 0.65 Da for ions with a mass to charge ratio (m/z) of 150.

Figure 9A:
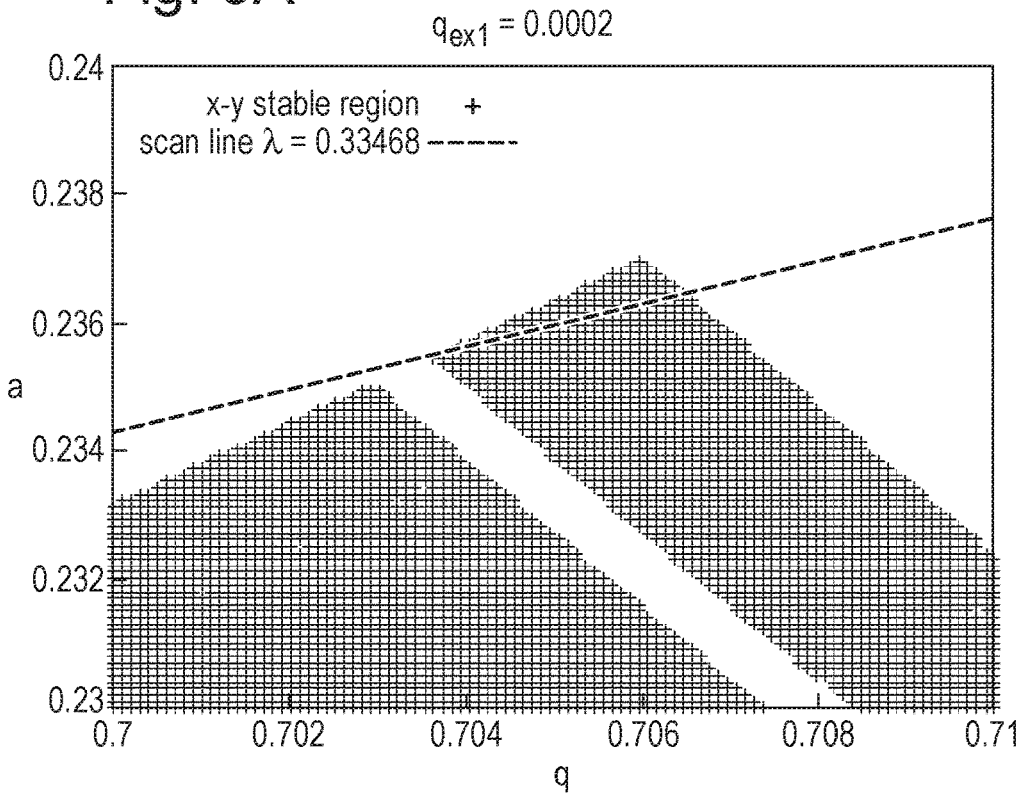
FIG. 9 shows a stability diagram and a simulated peak for a quadrupole mass filter operating in an X-band mode of operation, where $q_{ex1}$=0.0002.
Figure 9B:
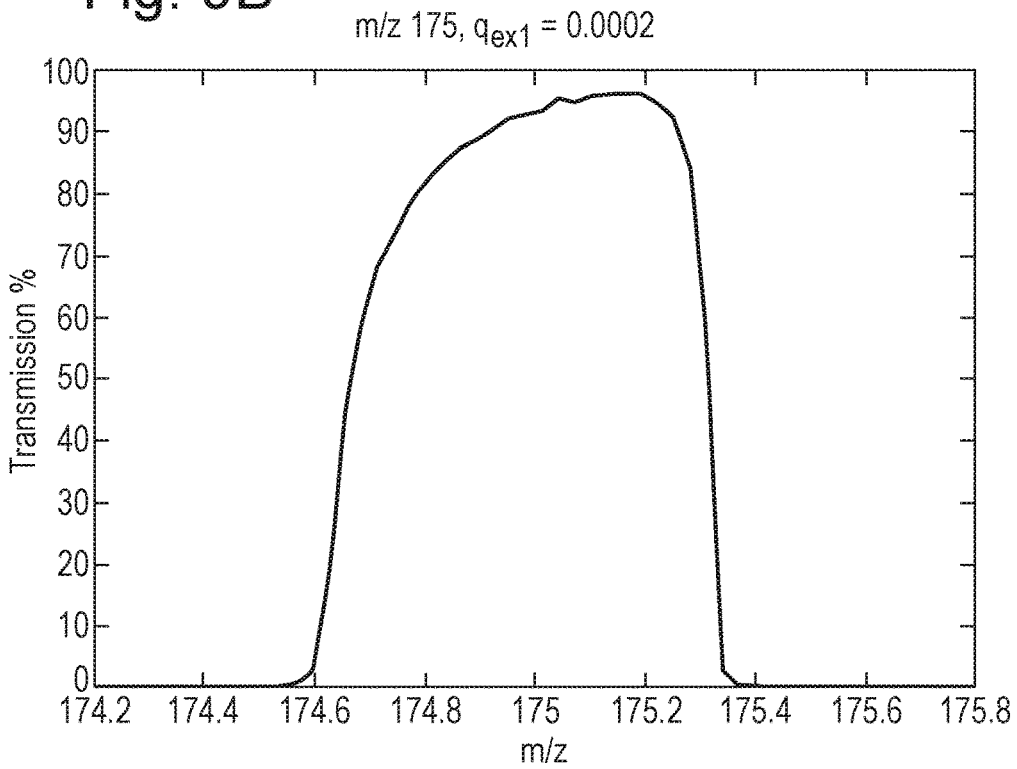

FIG. 9 shows simulated data for X-band operation where $q_{ex1}$=0.0002. Using a scan line for which $\lambda=2U/V_{RF}=0.33468$ gives a FWHM of 0.65 Da for ions with a mass to charge ratio (m/z) of 175.

Figure 10A:
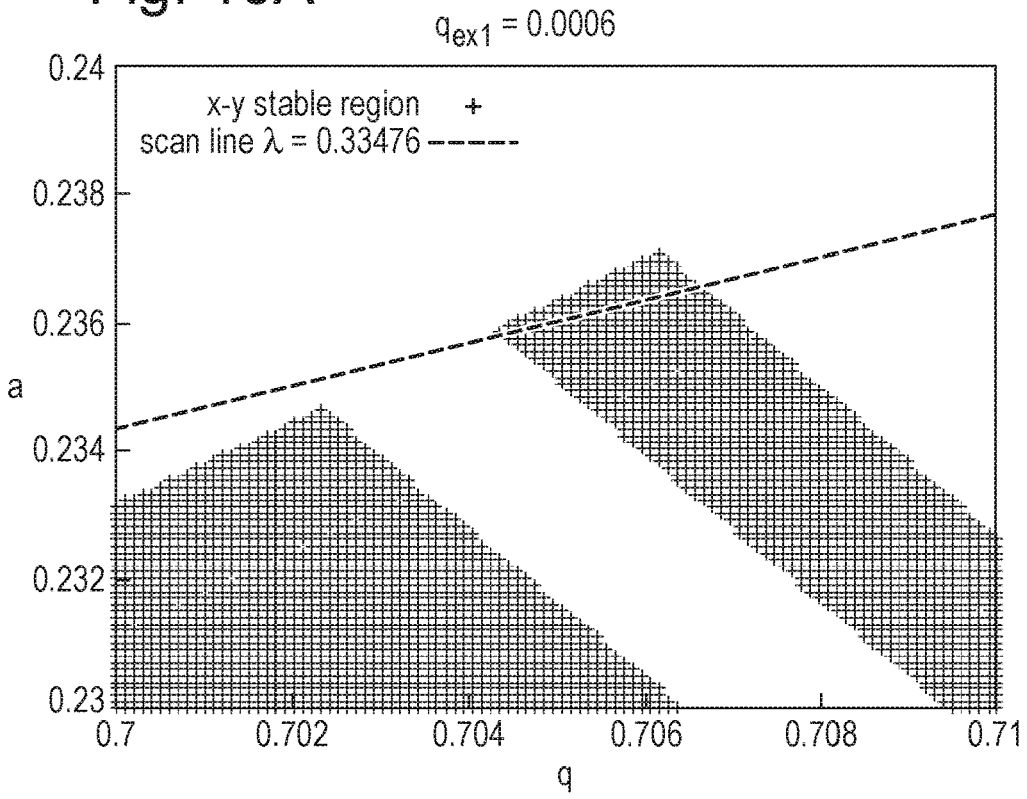
FIG. 10 shows a stability diagram and a simulated peak for a quadrupole mass filter operating in an X-band mode of operation, where $g_{ex1}$=0.0006.
Figure 10B:
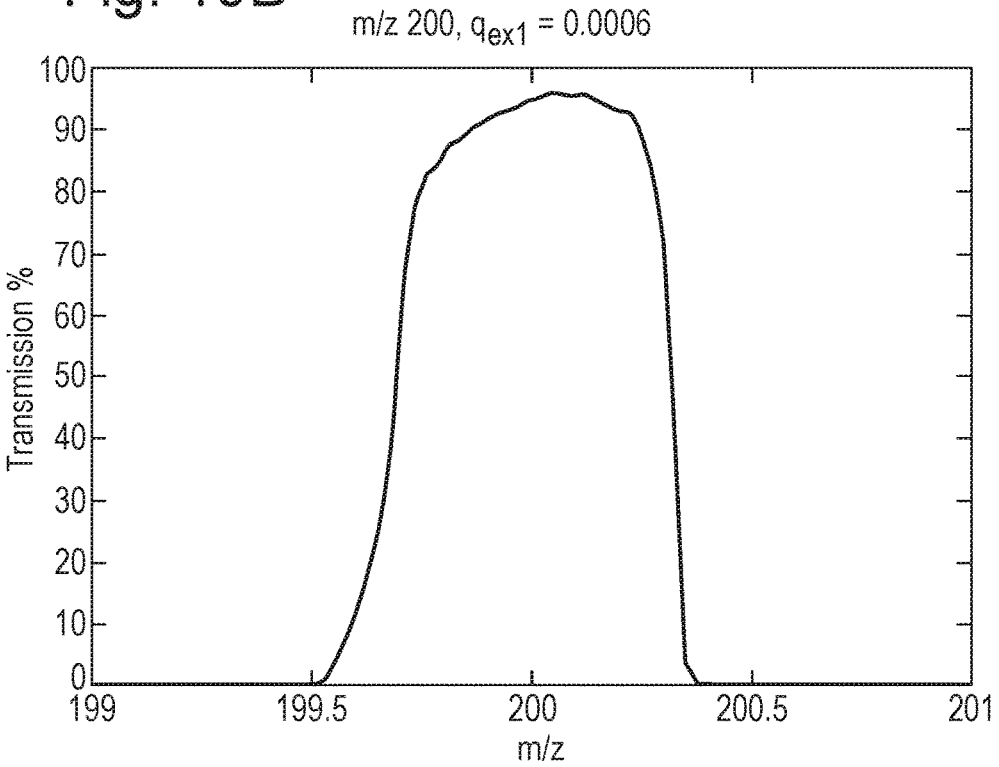

FIG. 10 shows simulated data for X-band operation where $q_{ex1}$=0.0006. Using a scan line for which $\lambda=2U/V_{RF}=0.33476$ gives a FWHM of 0.65 Da for ions with a mass to charge ratio (m/z) of 200.

Figure 11A:
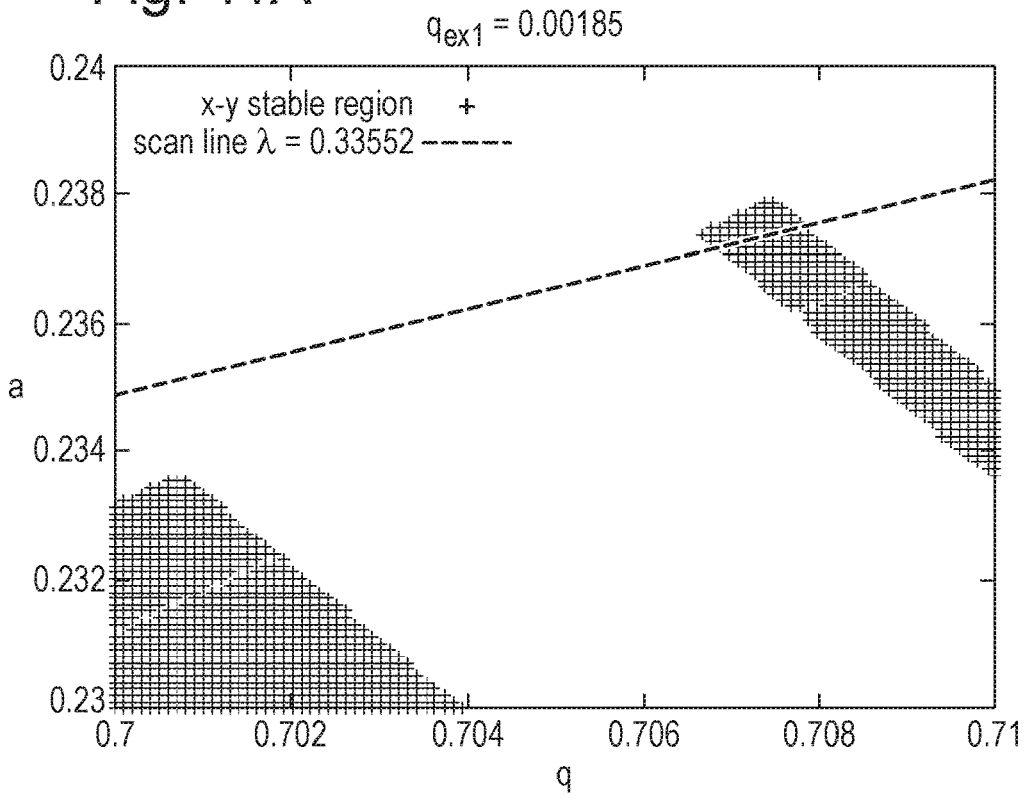
FIG. 11 shows a stability diagram and a simulated peak for a quadrupole mass filter operating in an X-band mode of operation, where $g_{ex1}$=0.00185.
Figure 11B:
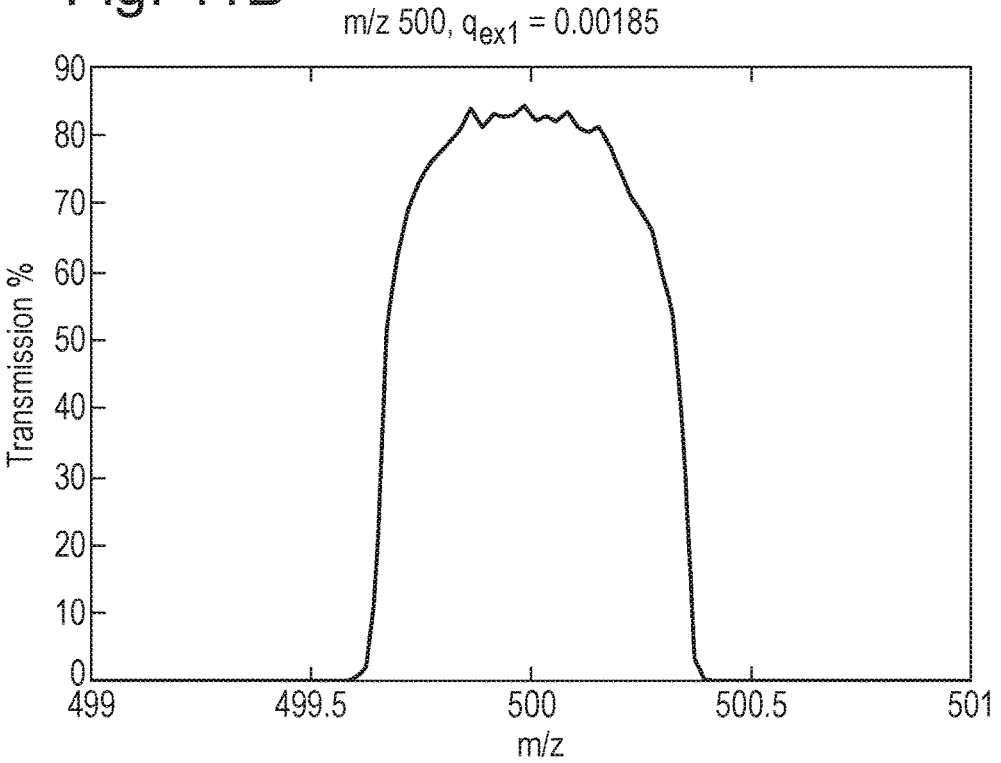
Figure 12A:
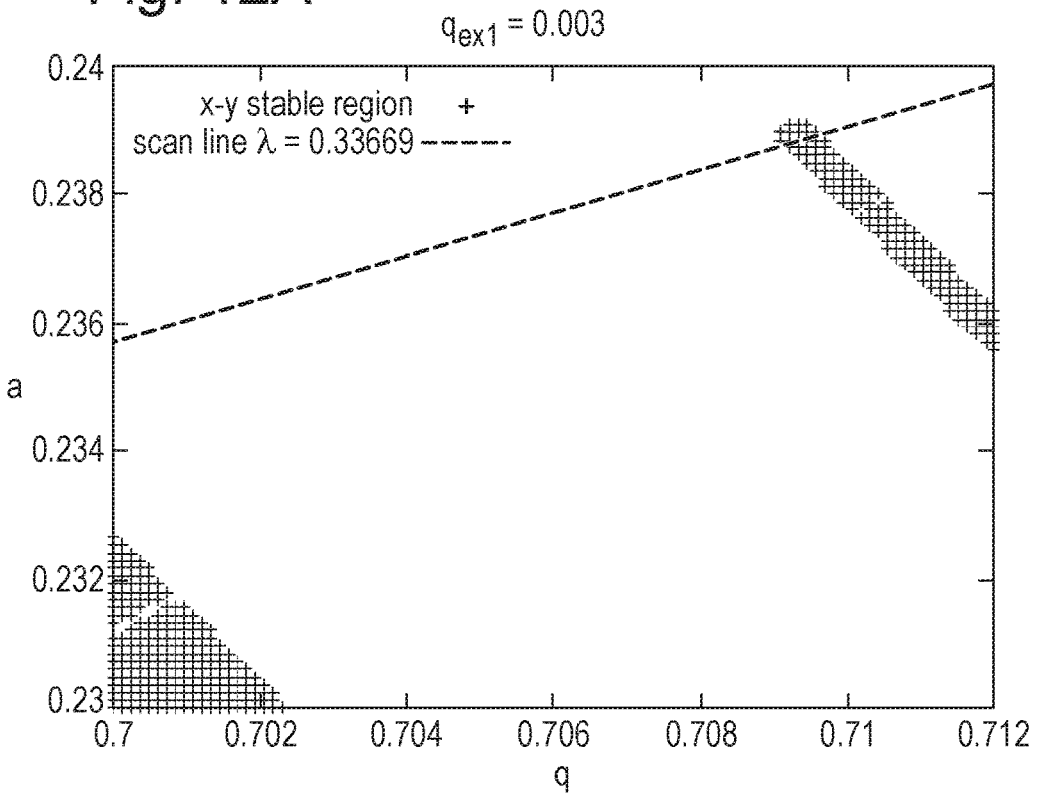
FIG. 12 shows a stability diagram and a simulated peak for a quadrupole mass filter operating in an X-band mode of operation, where =0.003.
Figure 12B:
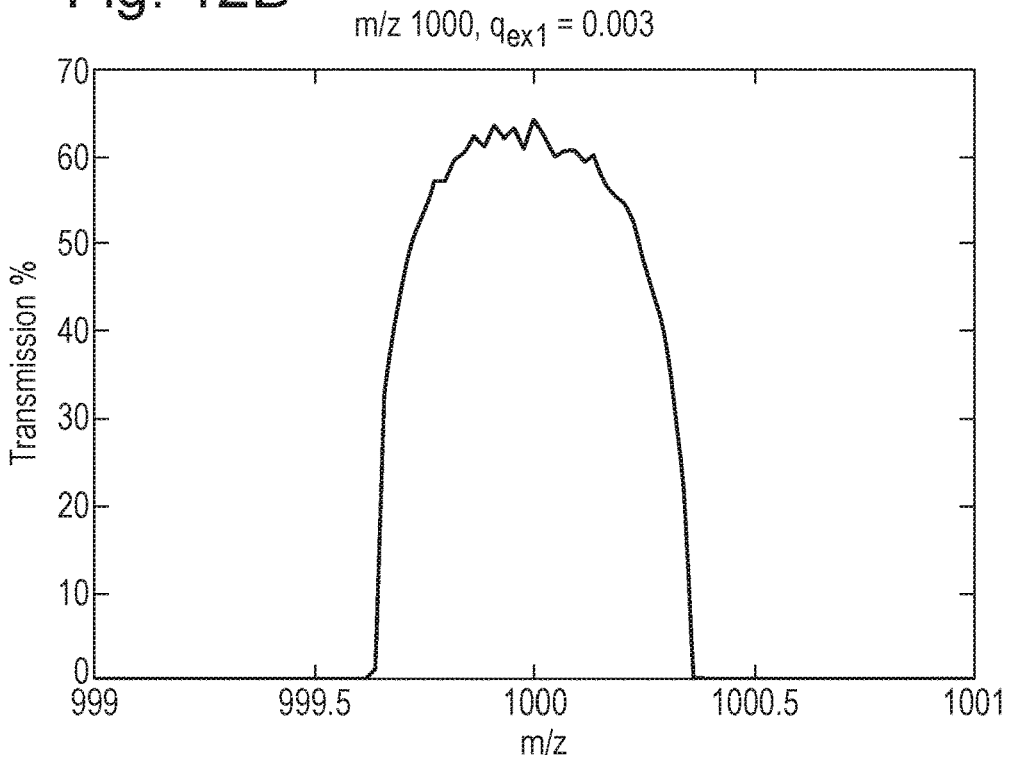

FIG. 11 shows simulated data for X-band operation where $q_{ex1}$=0.00185. Using a scan line for which $\lambda=2U/V_{RF}=0.33552$ gives a FWHM of 0.65 Da for ions with a mass to charge ratio (m/z) of 500.

FIG. 12 shows simulated data for X-band operation where $q_{ex1}$=0.003. Using a scan line for which $\lambda=2U/V_{RF}=0.33669$ gives a FWHM of 0.65 Da for ions with a mass to charge ratio (m/z) of 1000.

It will accordingly be appreciated that various embodiments allow X-band operation using practical excitation amplitudes over an extended mass to charge ratio (m/z) range without introducing discontinuities. This allows simple mass to charge ratio (m/z) calibration. In particular, by scanning, adjusting and/or varying the amplitudes of the applied auxiliary waveform pair, the resolution/transmission characteristic can be seamlessly controlled over the entire mass to charge ratio (m/z) range, thereby optimizing the transmission resolution characteristics at each mass to charge ratio (m/z) value.

As described above, the auxiliary parameters can be adjusted with mass to charge ratio (m/z) linearly or non-linearly to achieve constant FWHM. As can be seen in FIGS. 6-12, the transition from q of 0.706 to 0.710 results in a non-linear shift in mass to charge ratio position as X-band operation is introduced. Thus, in the X-band mode of operation, as resolution is increased, the X-band working point is pushed up to higher q-values, hence the location of the centre of the peak in a, q dimensions can change significantly.

Accordingly, correction of this may be done (e.g. via calibration or similar). This leads to a different and more complex calibration relationship between mass to charge ratio (m/z) and $V_{RF}/U/V_{RF}$ ratio. As such, a calibration between mass to charge ratio (m/z) and $V_{ext1}$ may be provided.

FIGS. 13-16 illustrate various examples of how the various parameters may be adjusted while maintaining constant mass to charge ratio (m/z).

Figure 13:
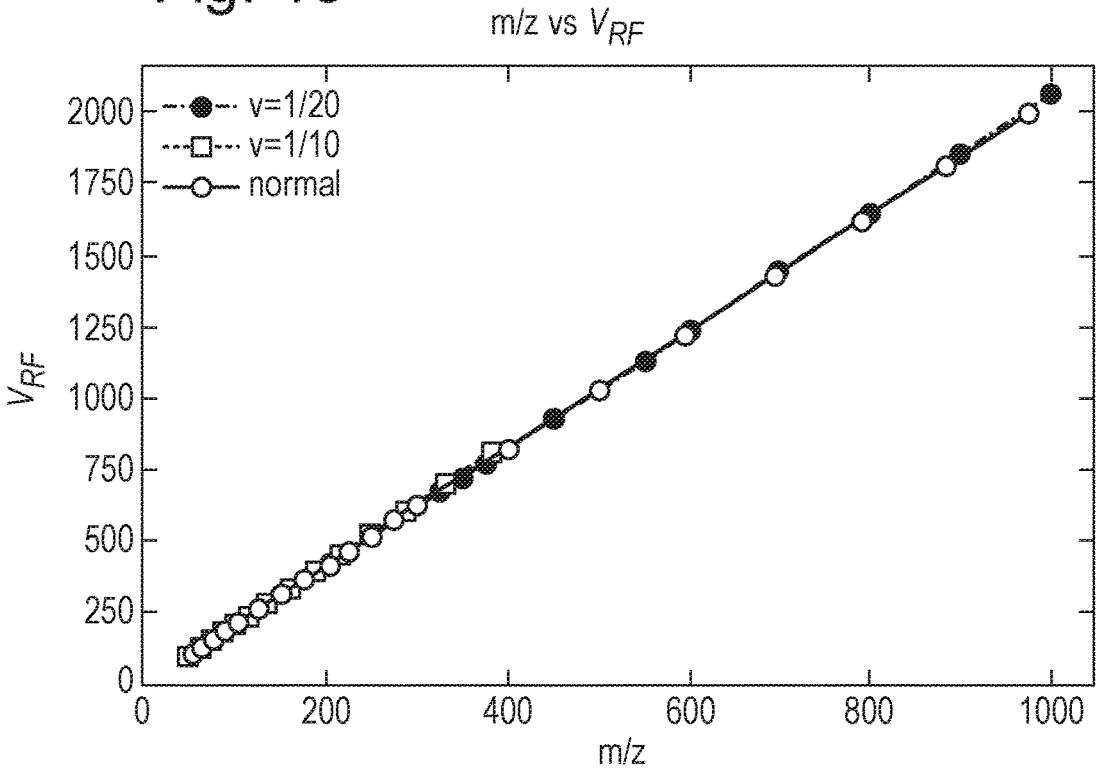
FIG. 13 shows a plot of mass to charge ratio (m/z) versus $V_{RF}$ for a quadrupole mass filter operating in a normal mode of operation and two X-band modes of operation, where v=1/20 and v=1/10.

FIG. 13 plots mass to charge ratio (m/z) against $V_{RF}$ for a quadrupole operating in the normal mode and for a quadrupole operating in two version of the X-band mode where the base frequency v is 1/20 and 1/10, respectively. The peak width maintained constant at 0.65 Da.

It can be seen that the relationship is approximately linear for all three modes. If a linear calibration function is applied for mass to charge ratio (m/z) versus $V_{RF}$ then, root mean square (RMS) residuals of 0.002% are obtained for the normal mode, 0.07% for the v=1/20 X-band mode, and 0.7% for the v=1/10 X-band mode. This demonstrates that the X-band modes are substantially less linear than the normal mode.

Figure 14:
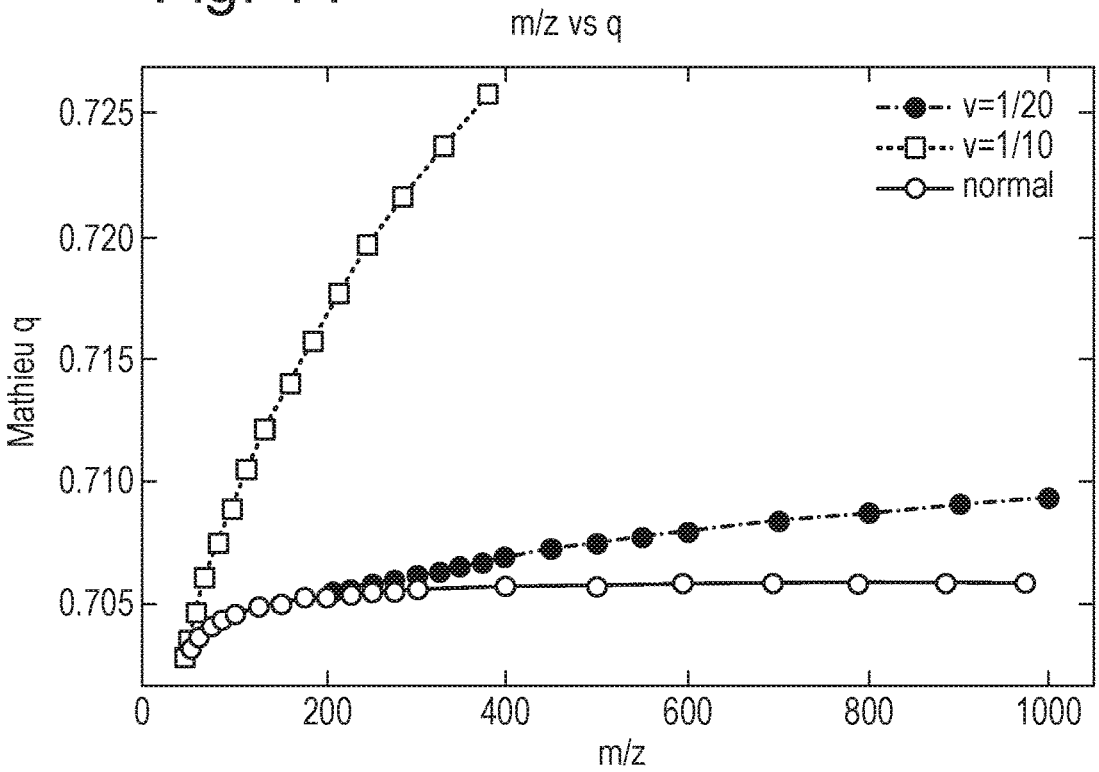
FIG. 14 shows a plot of mass to charge ratio (m/z) versus q for a quadrupole mass filter operating in the same modes of operation as are shown in FIG. 13.

FIG. 14 plots mass to charge ratio (m/z) versus Mathieu q-value for the same modes of operation as FIG. 13. Here, it is much easier to see that the relationship between mass to charge ratio (m/z) and q is significantly different for all three modes of operation. (Since $V_{RF}$ is proportional to q*m/z, small changes in $V_{RF}$ with mass to charge ratio (m/z) are difficult to see when $V_{RF}$ versus mass to charge ratio (m/z) is plotted.)

Figure 15:
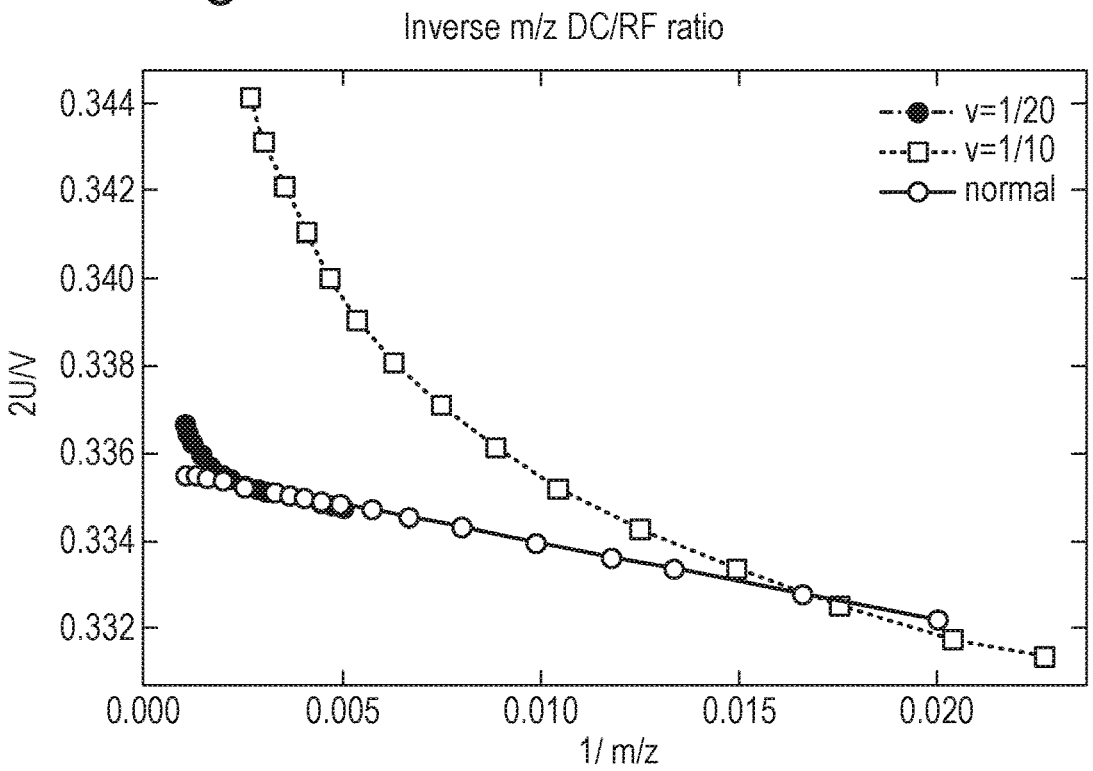
FIG. 15 shows a plot of the inverse of mass to charge ratio (m/z) versus the DC/RF ratio (here 2U/V==a/q) for a quadrupole mass filter operating in same modes of operation as are shown in FIG. 13.

FIG. 15 plots the inverse of mass to charge ratio (m/z) versus the DC/RF ratio (here 2U/V=a/q) for the same three modes of operation. For the quadrupole operating in the normal mode, a simple linear relationship can again be seen, while due to the shift of the X-band with resolution both X-band modes exhibit a non-linear relationship.

Control of the DC/RF ratio is normally used in the normal quadrupole mode to control the resolution. In the X-band mode, this ratio may be tuned to ensure the scan line cuts across the tip of the X-band, but there is much more tolerance to small deviations from the desired value.

Figure 16:
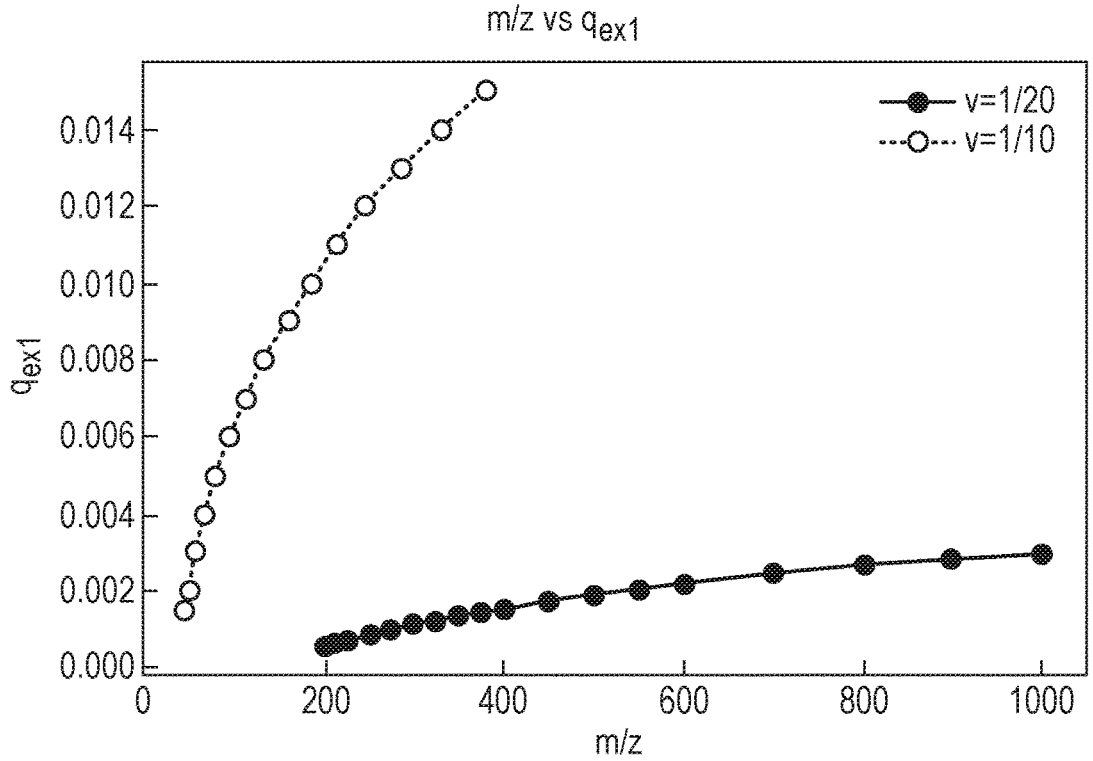
FIG. 16 shows a plot of mass to charge ratio (m/z) versus $q_{ex1}$ for a quadrupole mass filter operating in an X-band mode of operation, where v=1/20 and v=1/10.

FIG. 16 plots mass to charge ratio (m/z) versus $q_{ex1}$ for the X-band mode with base frequencies v of 1/20 and 1/10. It can be seen that neither relationship is linear. As described above, $q_{ex2}$ is usually related by a constant scaling factor to $q_{ex1}$. $V_{ext1}$ and $V_{ext2}$ are then related to $q_{ex1}$ and $q_{ex2}$ via the equation described above, i.e. mass to charge ratio (m/z) multiplied by a scaling factor. The data in FIG. 16 is plotted versus $q_{ex1}$ (instead of $V_{ex1}$) to make the variation clearer (as in FIG. 14).

Thus, in these embodiments, in order to scan, alter and/or vary the set mass of the quadrupole device, the amplitude of the main drive voltage $V_{RF}$ and the amplitude of the DC voltage U may be scanned, altered and/or varied without maintaining the ratio of the main resolving DC voltage amplitude to the main RF voltage amplitude $\lambda=2U/V_{RF}$ constant.

Although various embodiments above have been described in terms of transitioning from a normal mode to an X-band mode, i.e. by increasing the amplitudes of the auxiliary drive voltages while the set mass of the quadrupole device is increased, it would also be possible to operate the quadrupole device by decreasing its set mass, and e.g. decreasing the associated voltages linearly or non-linearly.

It can also be beneficial to use different modes of operation for different scan types (e.g. to use different modes of operation when scanning the quadrupole device 10, compared with when operating the quadrupole device discontinuously, e.g. in an MRM mode of operation). For example, a continuous transition between normal and X-band (or Y-band) modes of operation may be used, e.g. when scanning the quadrupole device, and/or a discontinuous transition may be used e.g. in MRM type modes of operation.

According to various embodiments, multiple scans using the normal mode and the X-band (or Y-band) mode could be acquired and stitched together to form a single spectrum.

In addition, the above techniques may be used to achieve other performance criteria, not just for achieving a constant FWHM across the mass to charge ratio range. For example, a confirmation scan in X-band (or Y-band) mode may be performed using a high resolution over a selected mass to charge ratio range where the appropriate base frequency v is selected.

Although various embodiments described above comprise a "Type I" excitation (from Table 1), i.e. where $v_1=v$, and $v_2=(1-v)$, it is possible to use any type of X-band excitation in accordance with various embodiments.

Although various embodiments above have been described in terms of the use of an X-band stability condition, it would also be possible to use a Y-band stability condition, e.g. in a corresponding manner, mutatis mutandi. A Y-band may be produced and used for mass to charge ratio (m/z) filtering (rather than an X-band) by application of suitable excitation frequencies.

It will be appreciated that various embodiments are directed to a method of utilising a quadrupole device selectively in X-band (or Y-band) mode and in normal mode, e.g. continuously or discontinuously. According to various embodiments, the benefits of X-band (or Y-band) quadrupole behaviour may be achieved whilst maintaining a constant peak width across the mass to charge ratio range. Various embodiments allow selective use of the X-band (or Y-band) and the normal mode, e.g. where appropriate.

Although as described above, in various embodiments, a single base frequency v may be used for the X-band mode of operation, according to various other embodiments, the base frequency may be altered, e.g. switched, during operation.

This may be done, in particular, when the set mass of the quadrupole device is altered discontinuously, e.g. when jumping in mass (e.g. in MRM modes of operation), i.e. where a smooth transition is not required. In this regard, for targeted analysis, the quadrupole mass filter may be switched discontinuously, i.e. so as to transmit ions having different mass to charge ratio (m/z) ranges at different times (i.e. rather than continuously scanning the transmission window over a defined mass to charge ratio (m/z) range).

Alternatively, the base frequency may be altered, e.g. switched, in a scanning mode of operation, e.g. by scanning the quadrupole device 10 over a portion of the desired mass to charge ratio (m/z) range using one particular base frequency v, altering (e.g. switching) the base frequency v, and then scanning the quadrupole device 10 over another (e.g. the next) portion of the desired mass to charge ratio (m/z) range.

Thus, according to various embodiments, the first mode of operation comprises a first X-band or Y-band mode of operation and the second mode of operation comprises a second different X-band or Y-band mode of operation, e.g. where in the first X-band or Y-band mode of operation the two or more auxiliary drive voltages comprise a particular auxiliary drive voltage pair type, and in the second different X-band or Y-band mode of operation the two or more auxiliary drive voltages comprises a different auxiliary drive voltage pair type.

As described above, when operating the quadrupole mass filter in the X-band mode, it is desirable to use auxiliary voltages with values of the base frequency v that give the optimum transmission resolution characteristic at each mass to charge ratio (m/z) value transmitted.

As described above, FIG. 4 shows a plot of $q_{ex1}$ versus log resolution ($q/\Delta q$) for a range of X-Band auxiliary base frequencies v. As is clear from FIG. 4 and as discussed above, there is a limit on the minimum resolution that can be obtained for a given value of the base frequency v.

For lower values of the base frequency v (e.g. $v=1/20=0.05$), the minimum achievable resolution is higher than for higher values of the base frequency v (e.g. $v=1/10=0.1$). However, for higher values of the base frequency v (e.g. $v=1/10=0.1$), a higher value of q (and hence voltage) is required to obtain a high resolution, leading to practical issues with voltage supplies, etc. Furthermore, for higher values of the base frequency v, for higher resolution, the operating point is shifted significantly to higher q, leading to a loss of acceptance and hence transmission.

Therefore in operation the amplitude and/or frequency of each of the two or more auxiliary voltages may be different when the quadrupole is set to transmit different mass to charge ratio (m/z) values. For example, the quadrupole device 10 may be set to transmit a first mass to charge ratio (m/z) range for a first dwell time $T_1$ using a first base frequency, e.g. $v=1/20$. The conditions may then be changed, e.g. during an inter channel delay time, to transmit a different mass to charge ratio (m/z) range with an X-band excitation that uses a second different base frequency, e.g. $v=1/10$.

As described above, the higher value of v may be used at relatively low mass to charge ratios (m/z), while the lower value of v may be used at relatively higher mass to charge ratios (m/z).

The particular values of $V_{RF}$, U, v, $V_{ext1}$, $V_{ext2}$, etc. that are required to achieve the desired performance for each mass to charge ratio (m/z) range may, e.g., be determined experimentally prior to the analysis, e.g. using a reference standard.

According to various embodiments, multiple scans using different base frequencies v could be acquired and "stitched" together to form a single spectrum.

Another approach according to various embodiments to obtain a wide resolution range, e.g. while scanning the set mass of the quadrupole device 10, is to initially operate the quadrupole device 10 in a Y-band mode, and to (e.g. gradually) transition to an X-band mode. Since as described above, the Y-band mode typically yields a lower resolution than the X-band mode, this may be done so as to achieve a constant FWHM across the mass range.

Thus, according to various embodiments, the first mode of operation comprises a Y-band mode of operation and the second mode of operation comprises an X-band mode of operation.

FIGS. 17-21 show stability diagrams illustrating this transition. FIGS. 17-21 show stability diagrams for modes of operating in which the base frequency is set to v=1/20, and the amplitude of the first auxiliary RF or AC voltage is set to $q_{ex1}=5.4e^{-4}$ (this is approximately the lowest value that can be used to obtain an X-band mode of operation). The scan line is set at a fixed DC/RF ratio (2U/V=0.33468). Each of FIGS. 17-21 show a mode of operation in which the amplitude $q_{ex2}$ of the second auxiliary RF or AC voltage is varied between $-1.6q_{ex1}$ (Y-band mode) and $2.915q_{ex1}$ (X-band mode). Note that at the point where $q_{ex2}=0$ a single auxiliary excitation is applied.

Figure 17:
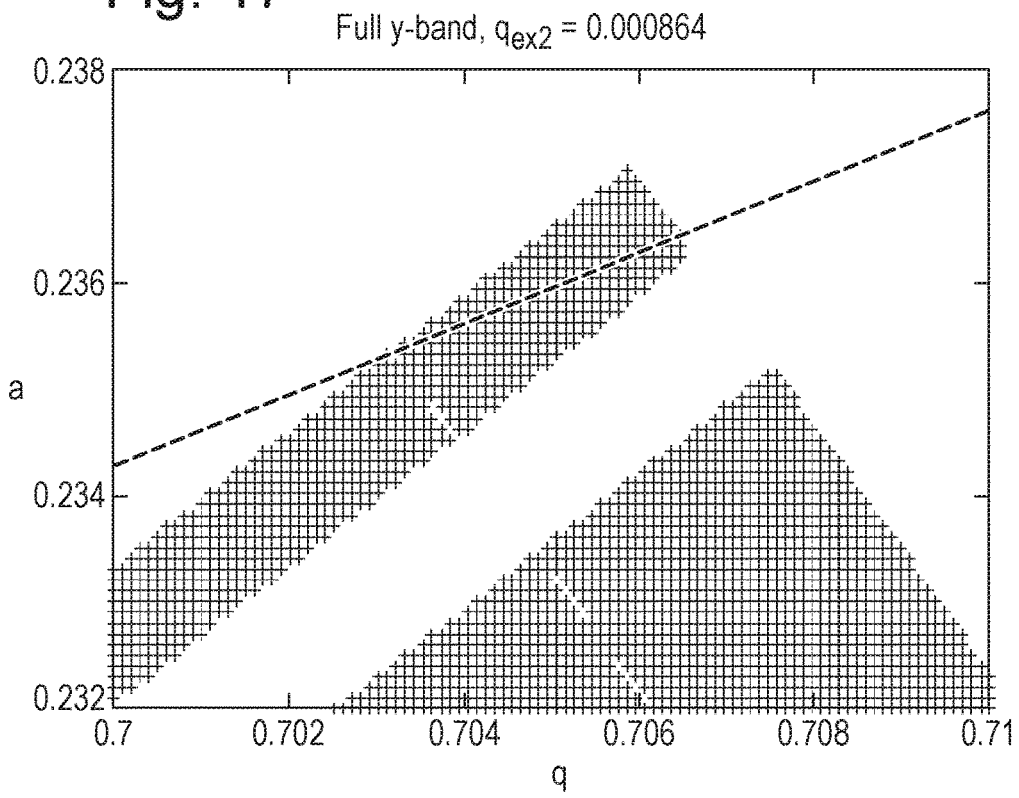
FIG. 17 shows a stability diagram for a quadrupole mass filter operating in an Y-band mode of operation, where v=1/20, $q_{ex1}=5.4e^{-4}$, and $q_{ex2}=-1.6q_{ex1}$.
Figure 18:
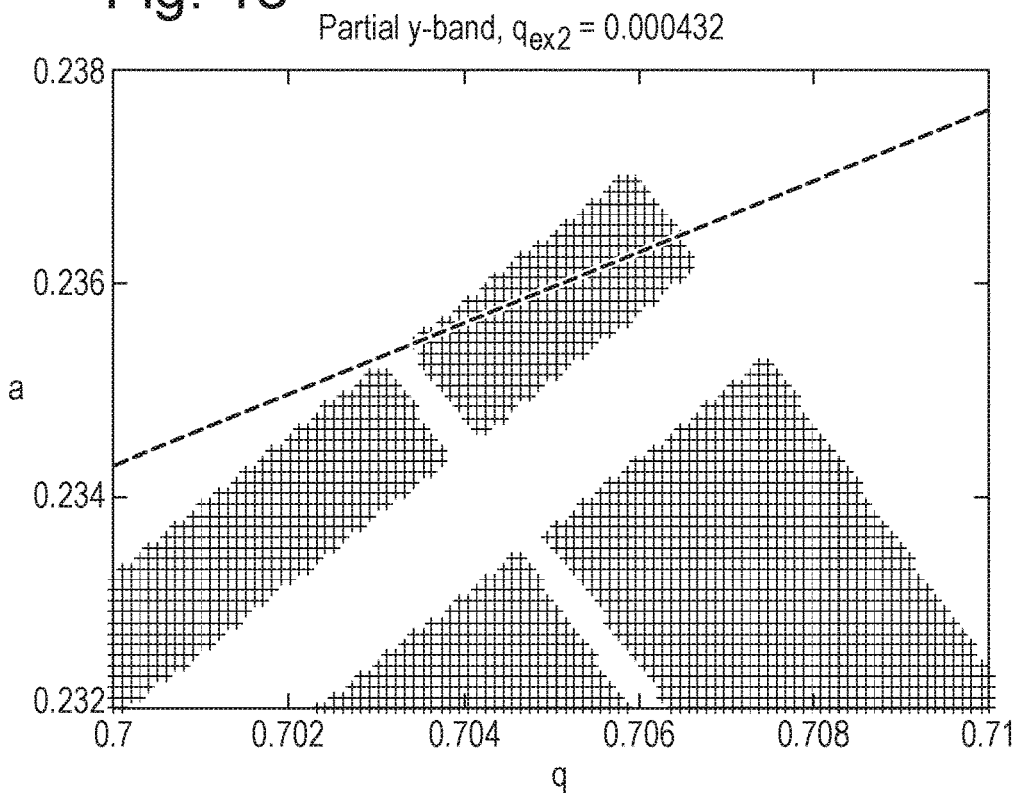
FIG. 18 shows a stability diagram for a quadrupole mass filter operating in a partial Y-band mode of operation, where v=1/20, $q_{ex1}=5.4e^{-4}$, and $q_{ex2}=-0.8q_{ex1}$.
Figure 19:
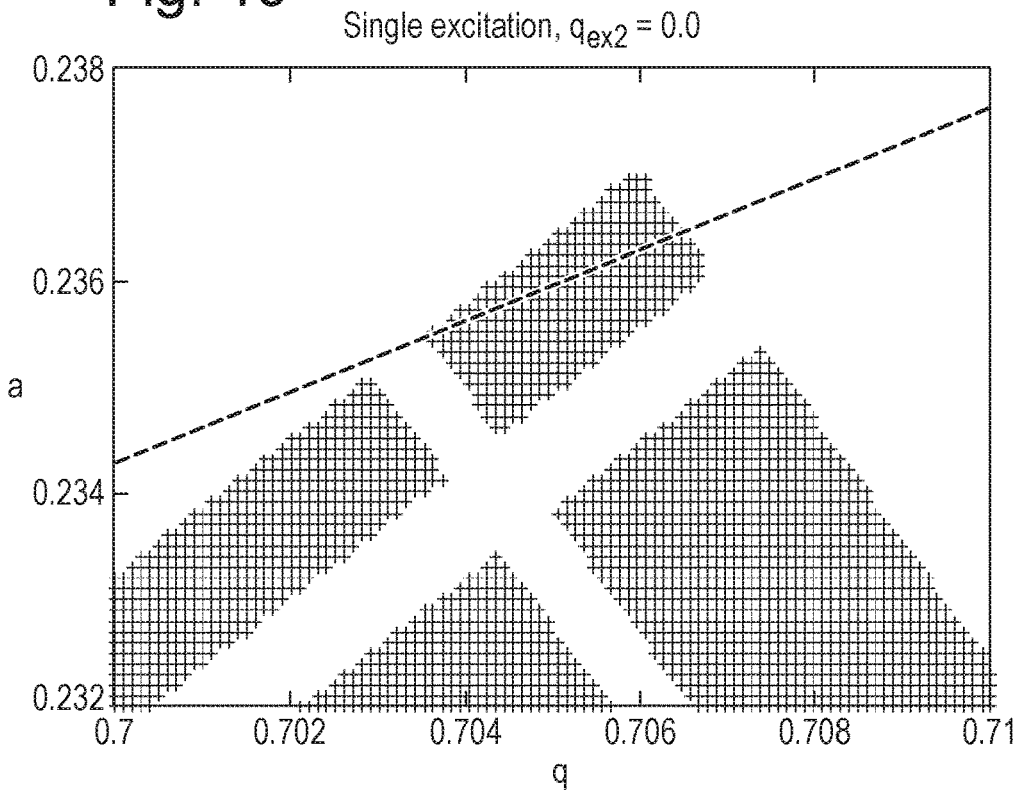
FIG. 19 shows a stability diagram for a quadrupole mass filter operating in a mode of operation, where v=1/20, $q_{ex1}=5.4e^{-4}$, and $q_{ex2}=0q_{ex1}$.
Figure 20:
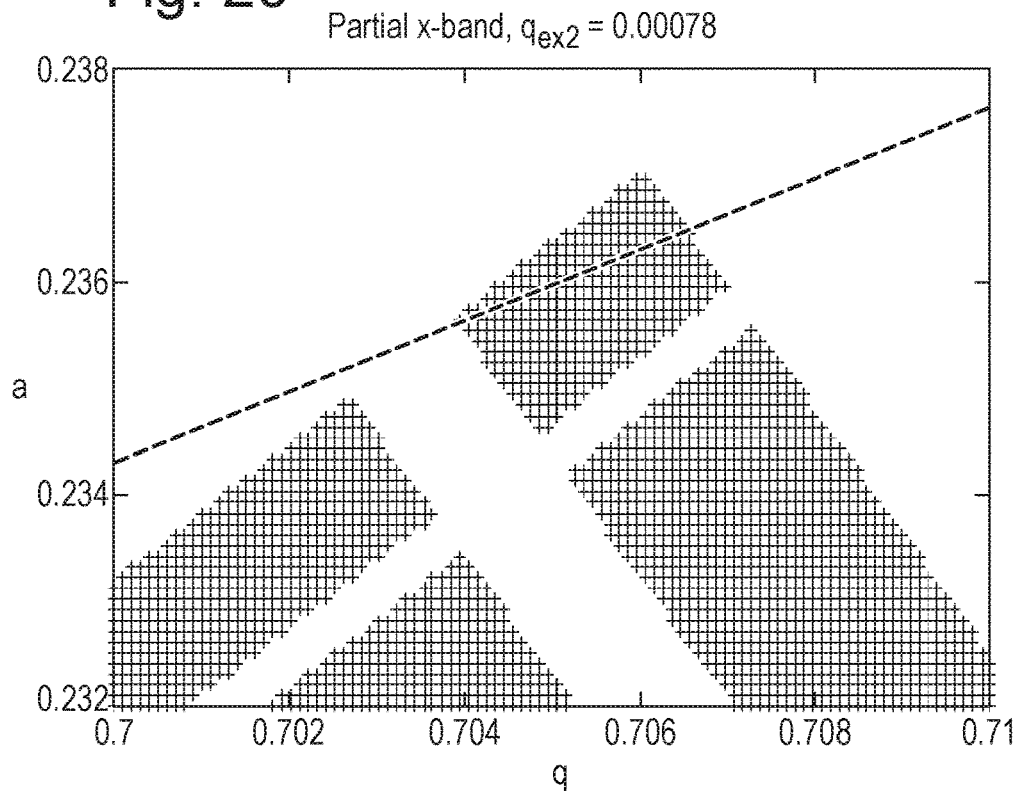
FIG. 20 shows a stability diagram for a quadrupole mass filter operating in a partial X-band mode of operation, where v=1/20, $q_{ex1}=5.4e^{-4}$, and $q_{ex2}=1.45q_{ex1}$.
Figure 21:
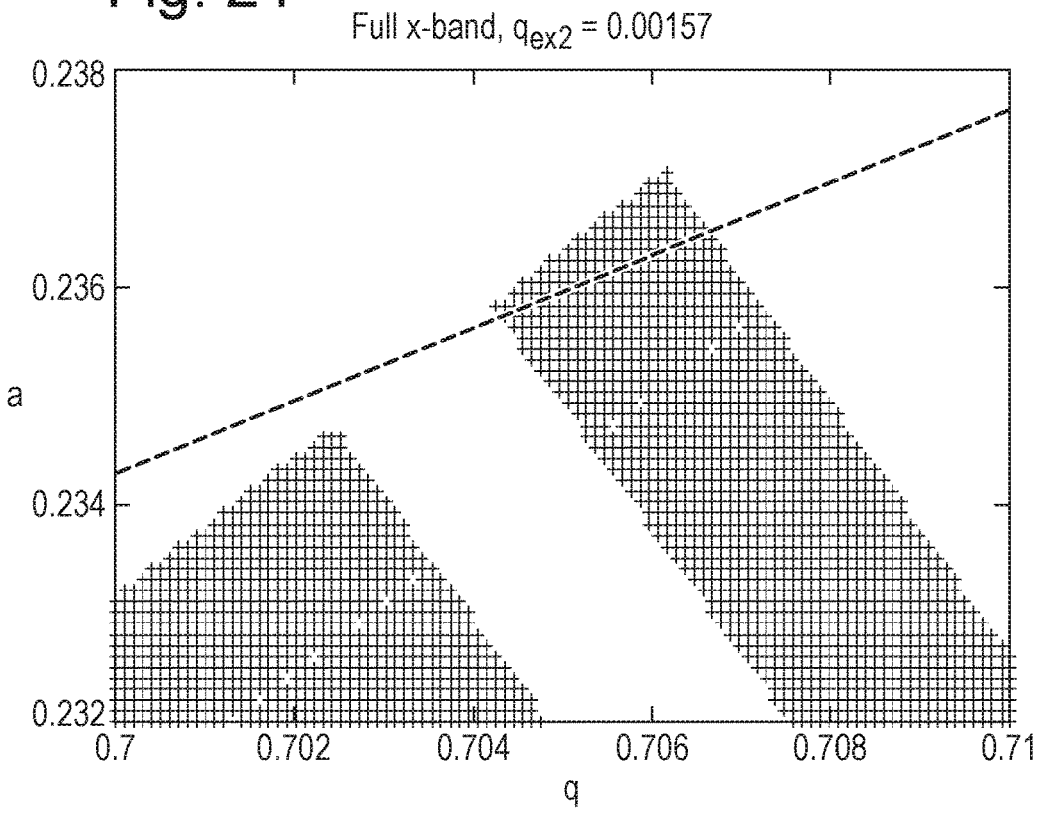
FIG. 21 shows a stability diagram for a quadrupole mass filter operating in an X-band mode of operation, where v=1/20, $q_{ex1}=5.4e^{-4}$, and $q_{ex2}=2.915q_{ex1}$.

In FIG. 17, $q_{ex2}=-1.6q_{ex1}$ and the width Δq of the stable part of the scan line is Δq=0.0034. In FIG. 18, $q_{ex2}=-0.8q_{ex1}$ and Δq=0.0031. In FIG. 19, $q_{ex2}=0q_{ex1}$, and Δq=0.0029. In FIG. 20, $q_{ex2}=1.45q_{ex1}$, and Δq=0.0026. In FIG. 21, $q_{ex2}=2.915q_{ex1}$, and Δq=0.0023.

This demonstrates that by scanning $q_{ex2}$ (e.g. as a function of $q_{ex1}$), a smooth transition can be made from Y-band mode to X-band mode, while decreasing the FWHM (peak width).

Thus, according to various embodiments the resolution of the quadrupole device 10 is scanned, altered and/or varied by scanning, altering or varying the amplitude ratio between the two auxiliary drive voltages.

As described above, the quadrupole device 10 (e.g. quadrupole mass filter) may be operated using one or more sinusoidal, e.g. analogue, RF or AC signals. However, it is also possible to operate the quadrupole device 10 using one or more digital signals, e.g. for one or more or all of the applied drive voltages. A digital signal may have any suitable waveform, such as a square or rectangular waveform, a pulsed EC waveform, a three phase rectangular waveform, a triangular waveform, a sawtooth waveform, a trapezoidal waveform, etc.

Figure 22:
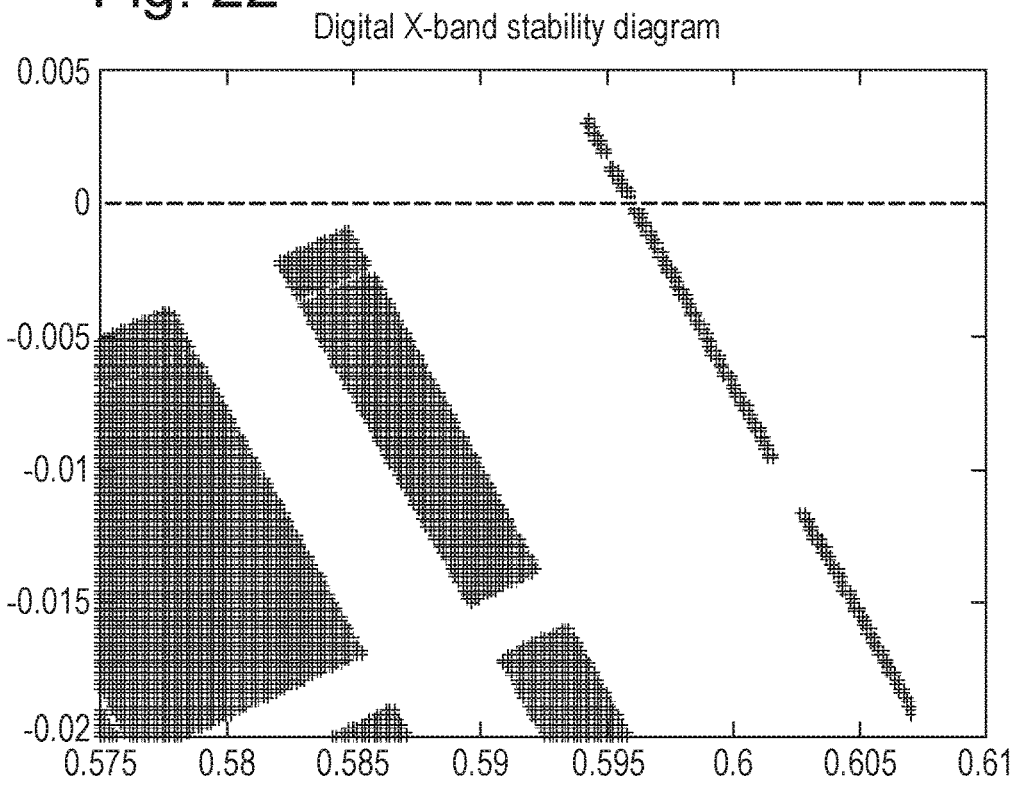
FIG. 22 shows a stability diagram for a quadrupole mass filter operating in a digital X-band mode of operation, where v=1/20, and $q_{ex1}$=0.003.

FIG. 22 shows an example stability diagram for a digitally driven quadrupole operating in an X-band mode. The duty cycle of the main waveform is 61.15/38.85. The duty cycle of each of the auxiliary waveforms is 50/50, where the base frequency v=1/20, and $q_{ex1}=0.003$. Also shown in FIG. 22 is the scan line with a=0. The working point is where this line cuts across the X-band.

In digitally driven quadrupoles (operating in the normal mode), the frequency Ω of the main RF voltage can be altered (e.g. scanned) to change the set mass (mass to charge ratio (m/z)) of the quadrupole device, i.e. instead of altering (e.g. scanning) the ratio $U/V_{RF}$. Thus, according to various embodiments, the frequency Ω of the main drive voltage is scanned, altered and/or varied in order to scan, alter and/or vary the set mass of the quadrupole device 10.

Furthermore, (in the normal mode) the duty cycle of the digital waveform can be altered, e.g. to position the tip of the stability diagram on the a=0 line. This allows mass filtering without using a resolving DC voltage (i.e. where equal and opposite voltages are applied sequentially as the digital waveform). Adjustment of the resolution may then be accomplished by adjustment of the duty cycle.

Thus, according to various embodiments, the main drive voltage comprises a repeating voltage waveform such as a square or rectangular waveform, and the duty cycle of the repeating voltage waveform is scanned, altered and/or varied so as to scan, alter and/or vary the resolution of the quadrupole device 10.

According to various embodiments, a digitally driven quadrupole may be operated in X-band or Y-band mode. Similar X-band or Y-band instability characteristics can be shown to exist for a digital drive voltage (compared to an analogue (harmonic) drive voltage), but the auxiliary waveforms require slightly different amplitude, frequency and phase characteristics.

In a digital system, it is practically feasible to scan the frequencies, hence smooth calibration functions over a wide resolution range can be obtained by smoothly scanning the auxiliary frequencies. Thus, according to various embodiments, in the X-band (or Y-band) mode, the frequency Ω of the main drive voltage and/or the frequencies $\omega_{exn}$ the auxiliary drive voltages are scanned, altered and/or varied to scan, alter and/or vary the set mass of the quadrupole device 10.

According to various embodiments, in the X-band (or Y-band) mode, the duty cycle of the main waveform can be adjusted to position the X-band (or Y-band) working point on the a=0 line. Thus according to various embodiments, the quadrupole device 10 may be operated in the X-band (or Y-band) mode without applying a resolving DC voltage to the quadrupole device 10.

In a digitally driven quadrupole operating in the normal mode without a resolving DC voltage, the resolution may be controlled by precise adjustment of the duty cycle (this is analogous to precise control of the UN ratio). In contrast, in the digital X-band (or Y-band) mode of operation, the resolution may be controlled by adjustment of the parameters of the auxiliary voltages. This means that in the digital X-band (or Y-band) mode of operation, it is not necessary to be able to control the duty cycle precisely, i.e. a considerably coarser level of control of the duty cycle is sufficient. This makes the hardware requirements less exacting.

In order to extract useful mass to charge ratio (m/z) data the quadrupole mass filter 10 may be calibrated. During calibration, the relationship between transmitted mass to charge ratio (m/z) and applied RF voltage $V_{RF}$ may be determined, e.g. using a reference standard comprising species with multiple mass to charge ratio (m/z) values. The form of this calibration may depend on the values of U, v, $V_{ext1}$, $V_{ext2}$ chosen at each mass to charge ratio (m/z) value to give the desired performance.

The relationship between the operational parameters required for desired performance and $V_{RF}$ may be determined during a set-up procedure, e.g. using standard reference compounds. In effect there may be a set of calibration functions relating each of $V_{RF}$, the DC/RF ratio ($U/V_{RF}$), and $V_{ext1}$ to mass to charge ratio (m/z). ($V_{ext2}$ is usually simply related to $V_{ext1}$). While the calibration of $V_{RF}$ to mass to charge ratio (m/z) is usually referred to, it should be understood that the other parameters are also effectively calibrated.

For best results it is desirable that the form of the calibration function(s) should take into account the predicted general relationship between the changing operational parameters and mass to charge ratio (m/z) range transmitted. For systems where there is an abrupt discontinuity in this relationship at a particular mass to charge ratio (m/z) value (e.g. as described above), multiple overlapping calibration functions may be required and used.

Thus, according to various embodiments, the quadrupole device 10 is operated using two (or more) (sets of) calibration functions or curves. Each of the two or more (sets of) calibration functions or curves may be defined (and used) for a particular mass to charge ratio range.

Thus, a first calibration function or curve (set) may be used for a first mass to charge ratio range, and a second different calibration function or curve (set) may be used for a second different mass to charge ratio range. The first and second mass to charge ratio ranges may be mostly or entirely mutually exclusive (i.e. may not overlap in mass to charge ratio or may overlap in mass to charge ratio by a relatively small amount).

According to various embodiments, the quadrupole device (control system) may be configured to select one of the two or more (sets of) calibration functions or curves, e.g. depending on the mass to charge ratio at which ions are selected and/or transmitted by (the set mass of) the quadrupole device 10, and to use the selected calibration function or curve (set) in operation.

Each (set of) calibration function(s) may relate the mass to charge ratio and/or mass to charge ratio range at which ions are selected and/or transmitted by the quadrupole device to one or more of: (i) the main drive voltage amplitude $V_{RF}$; (ii) one or more or each of the auxiliary drive voltage amplitudes $V_{exn}$; (iii) the DC voltage amplitude U; and/or (iv) the ratio of the DC voltage amplitude to the main drive voltage amplitude $U/V_{RF}$.

Thus, where it is desired to operate the quadrupole device such that it selects and/or transmits ions with a particular mass to charge ratio and/or mass to charge ratio range, then the control system may use one of the (sets of) plural calibration functions to determine the appropriate value(s) of one or more or each of: (i) the main drive voltage amplitude $V_{RF}$; (ii) one or more or each of the auxiliary drive voltage amplitudes $V_{exn}$; (iii) the DC voltage amplitude U; and/or (iv) the ratio of the DC voltage amplitude to the main drive voltage amplitude $U/V_{RF}$, that should be applied to the quadrupole device in order to cause to quadrupole device to select and/or transmit ions with the particular mass to charge ratio and/or mass to charge ratio range.

Thus, operating the quadrupole device using the first calibration function (set) may comprise using the first calibration function (set) to determine the appropriate value(s) of one or more or each of: (i) the main drive voltage amplitude $V_{RF}$; (ii) one or more or each of the auxiliary drive voltage amplitudes $V_{exn}$; (iii) the DC voltage amplitude U; and/or (iv) the ratio of the DC voltage amplitude to the main drive voltage amplitude $U/V_{RF}$, that should be applied to the quadrupole device in order to cause to quadrupole device to select and/or transmit ions with a particular (desired) mass to charge ratio or mass to charge ratio range (within the first mass to charge ratio range), and then applying one or more or each of: (i) the determined main drive voltage; (ii) one or more or each of the determined auxiliary drive voltages; and/or (iii) the determined DC voltage, to the quadrupole device such that the quadrupole device selects and/or transmit ions with the particular (desired) mass to charge ratio or mass to charge ratio range.

Equally, operating the quadrupole device using the second different calibration function (set) may comprise using the second different calibration function (set) to determine the appropriate value(s) of one or more or each of: (i) the main drive voltage amplitude $V_{RF}$; (ii) one or more or each of the auxiliary drive voltage amplitudes $V_{exn}$; (iii) the DC voltage amplitude U; and/or (iv) the ratio of the DC voltage amplitude to the main drive voltage amplitude $U/V_{RF}$, that should be applied to the quadrupole device in order to cause to quadrupole device to select and/or transmit ions with a particular (desired) mass to charge ratio or mass to charge ratio range (within the second different mass to charge ratio range), and then applying one or more or each of: (i) the determined main drive voltage; (ii) one or more or each of the determined auxiliary drive voltages; and/or (iii) the determined DC voltage, to the quadrupole device such that the quadrupole device selects and/or transmit ions with the particular (desired) mass to charge ratio or mass to charge ratio range.

Each calibration function (e.g. within each calibration function set) may be a continuous function, i.e. the first calibration function (or each of the calibration functions within the first calibration function set) may be a continuous function and the second calibration function (or each of the calibration functions within the second calibration function set) may be a different continuous function. However, the two or more calibration functions (or each respective calibration function within the two or more calibration function sets) may be mutually discontinuous. That is, for at least some values of mass to charge ratio, the first and second calibration functions (or each respective calibration function within the first and second calibration function sets) may each define a different voltage value. The combination of the first and second functions (or of each respective calibration function within the first and second calibration function sets) may comprise a jump (or step) discontinuity (e.g. at the mass to charge ratio or mass to charge ratio range intermediate to the first and second mass to charge ratio ranges).

As described above, in a mode of operation the mass filter 10 may be operated in an X-band mode with excitation waveforms with one value of v over a specific range of $V_{RF}$ (i.e. mass to charge ratio), and with excitation waveforms with a different value of v over a different range of $V_{RF}$ (i.e. mass to charge ratio). The form of the calibration curve(s) may be different for these two ranges.

In this mode of operation two (sets of) calibration functions may be determined and used for the different excitation waveforms over the different ranges of $V_{RF}$. According to various embodiments, these ranges may overlap, e.g. for a small range of $V_{RF}$.

Figure 23:
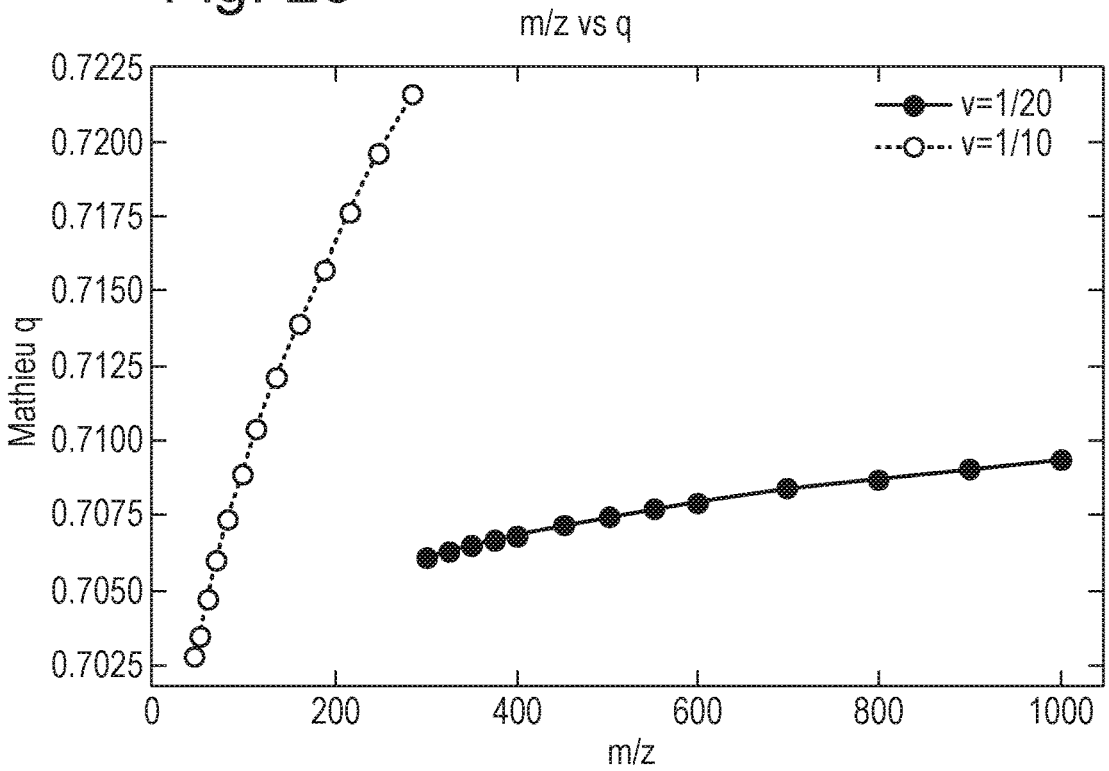
FIG. 23 shows a plot of mass to charge ratio (m/z) versus q for a quadrupole mass filter operating in two X-band modes of operation, where v=1/20 and v=1/10.

FIG. 23 shows an example of this, plotting mass to charge ratio (m/z) versus q for a quadrupole device using a 0.65 Da peak width. An X-band with v=1/10 is used up to m/z=300, where the quadrupole is switched to use an X-Band with v=1/20. There is a clear step change in q, hence a step change in $V_{RF}$. It is clearly impossible to fit a smooth function over the whole mass to charge ratio (m/z) range in this example.

In operation, the quadrupole device 10 may be switched, e.g. discontinuously, between different values of $V_{RF}$ and hence transmit different mass to charge ratio (m/z) ranges, e.g. in a pre-programmed sequence or in a data dependent manner. Depending on the mass to charge ratio (m/z) range transmitted, the relationship between $V_{RF}$ and mass to charge ratio (m/z) may be taken from one calibration function or the other.

More (sets of) calibration functions may be determined and used over more $V_{RF}$ ranges, e.g. depending on the number of different X-band (or Y-band) waveform combinations used to cover the mass to charge ratio (m/z) range of interest.

As described above, in a mode of operation the quadrupole mass filter 10 may be operated in an X-band mode with excitation waveforms with one value of v over a specific range of $V_{RF}$ (i.e. mass to charge ratio) and in a non-X-Band mode over a different range of $V_{RF}$ (i.e. mass to charge ratio). The form of the calibration curve(s) may also be different for these two ranges.

In this mode of operation two (sets of) calibration functions may be determined for the different ranges of $V_{RF}$.

Figure 24:
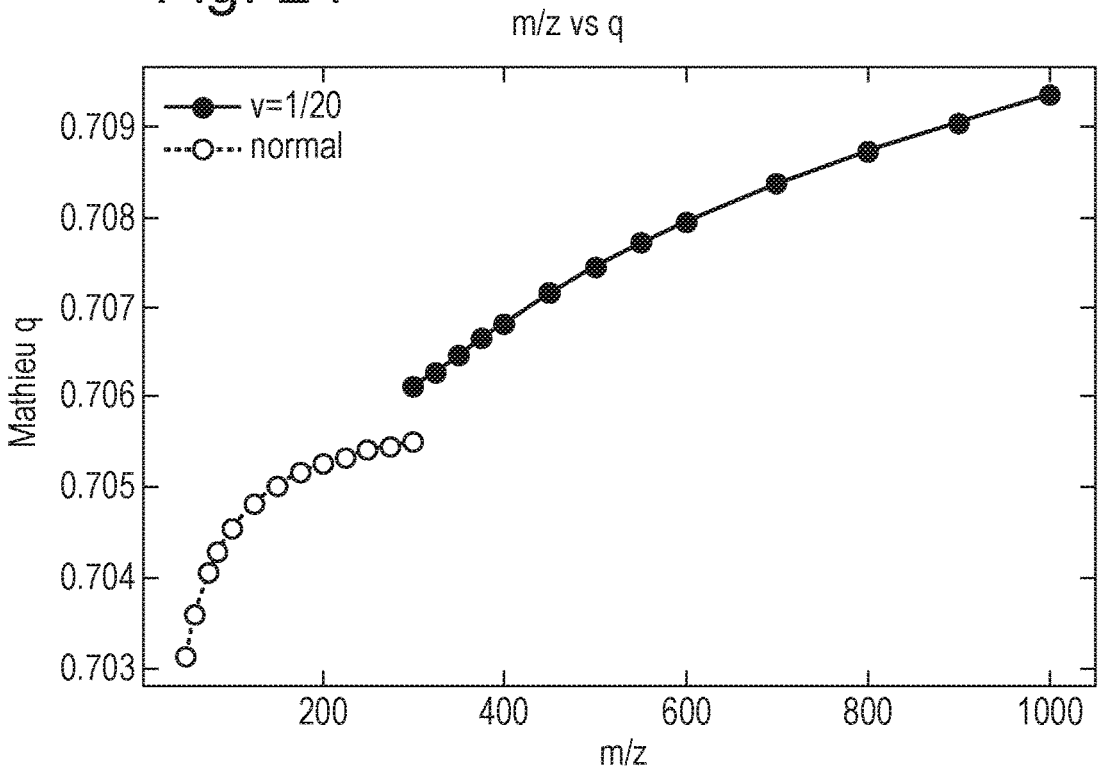
FIG. 24 shows a plot of mass to charge ratio (m/z) versus q for a quadrupole mass filter operating in a normal mode of operation and an X-band mode of operation, where v=1/20.
Figure 25:
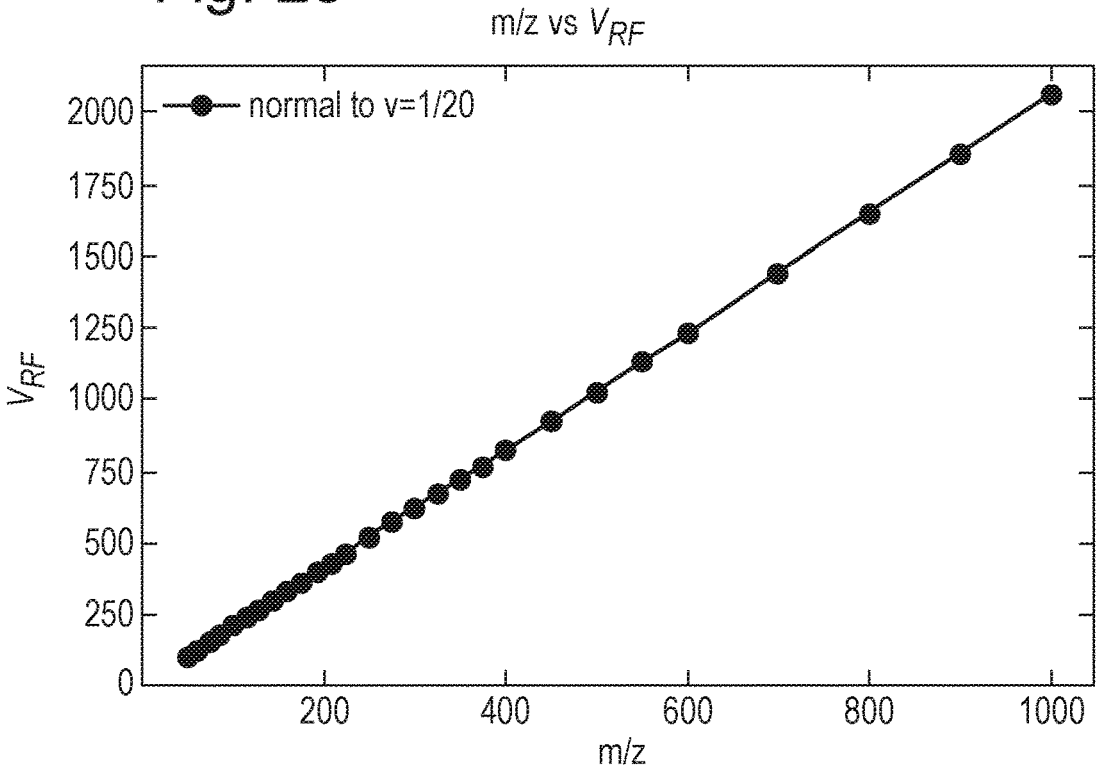
FIGS. 25-28 show calibration curves for a quadrupole mass filter operating in a normal mode of operation and an X-band mode of operation, where v=1/20.
Figure 26:
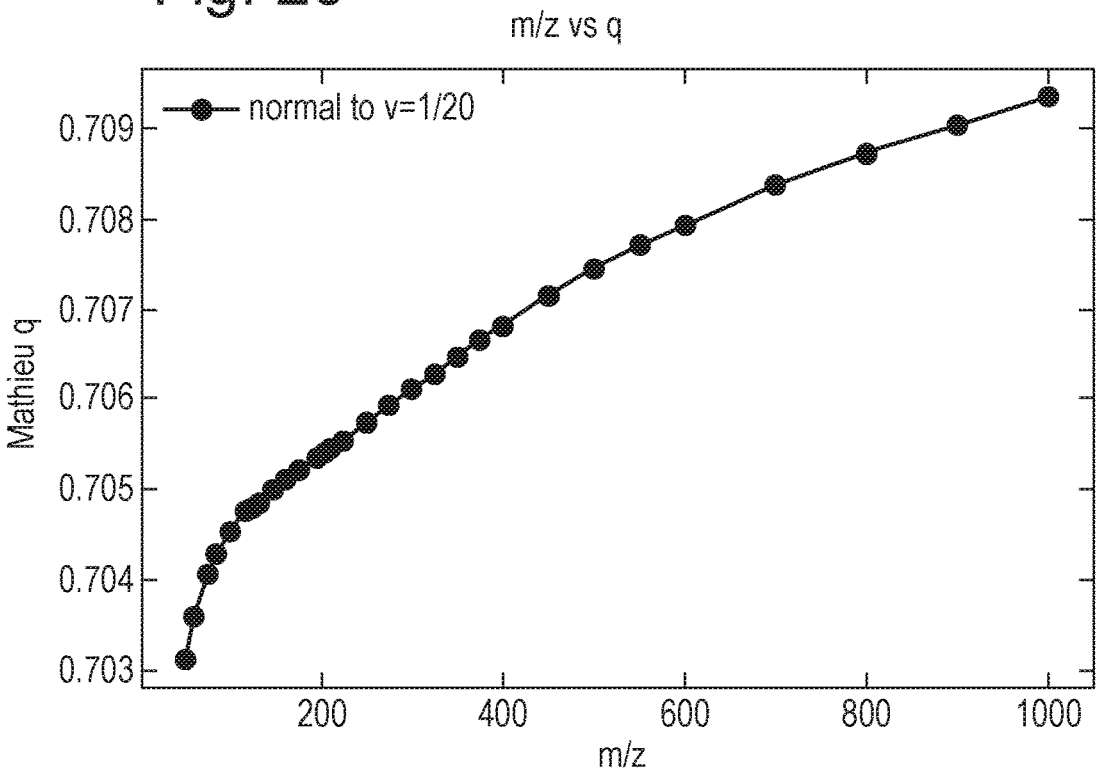
Figure 27:
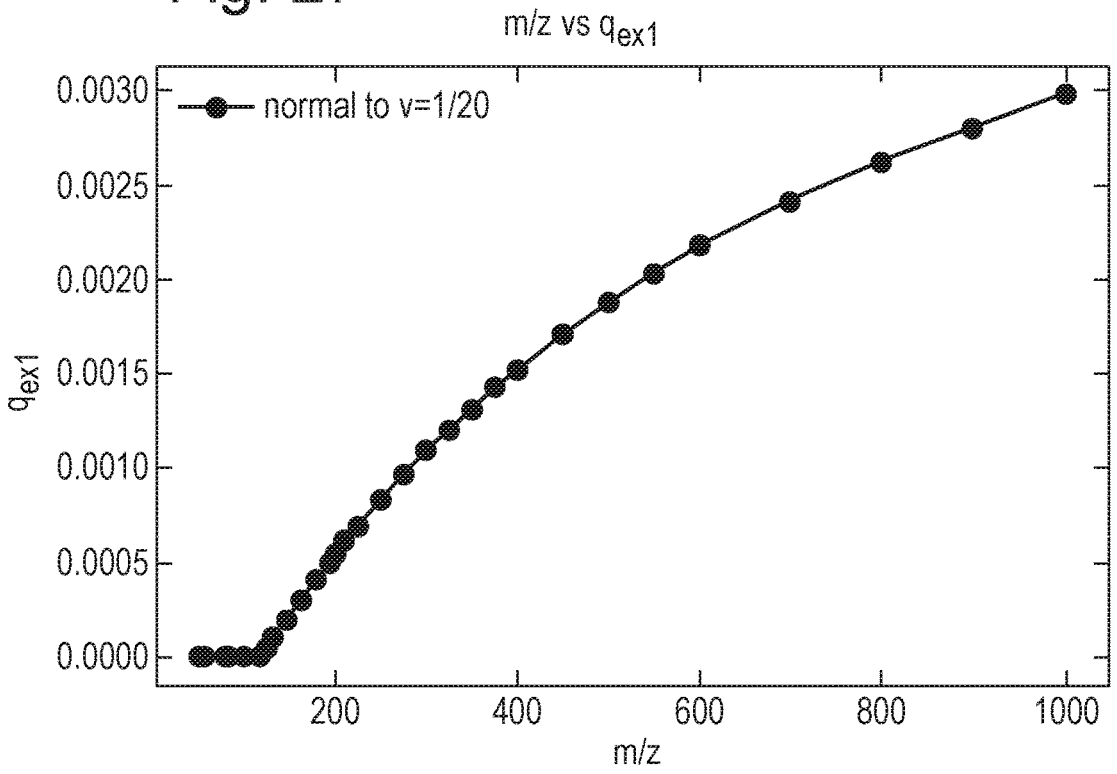
Figure 28:
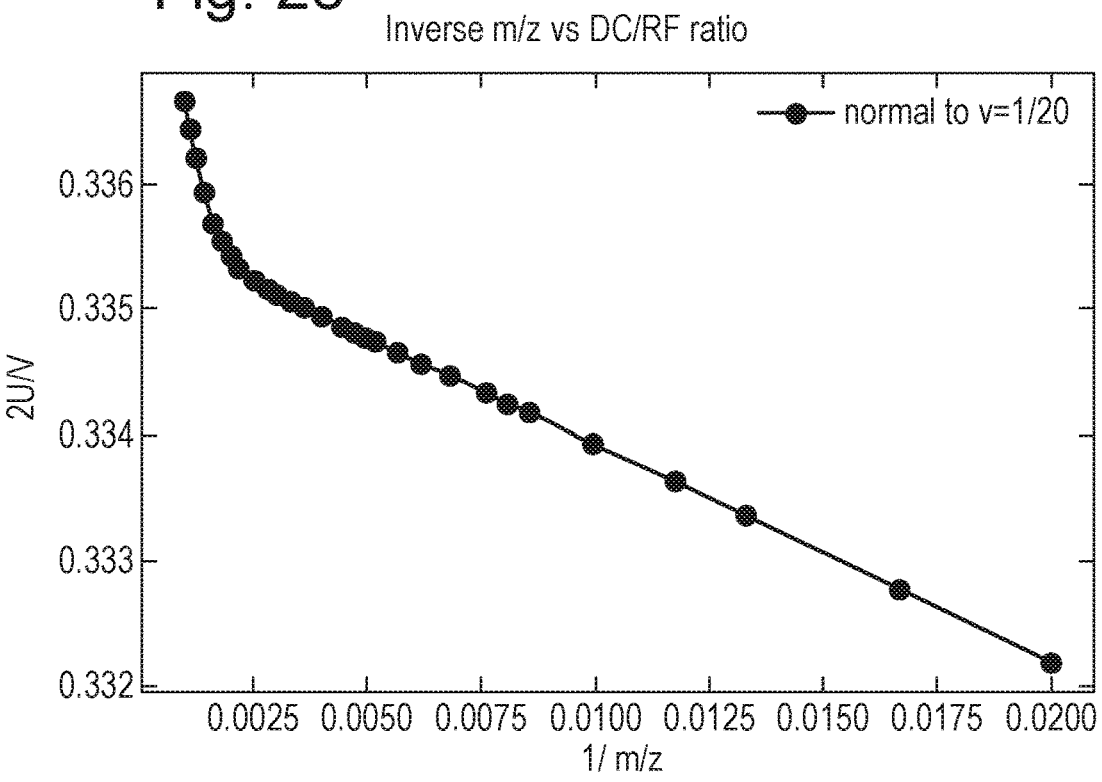

FIG. 24 shows an example of this, plotting mass to charge ratio (m/z) versus q for a quadrupole device 10 using a 0.65 Da peak width. The quadrupole device 10 is operated conventionally up to mass to charge ratio (m/z) 300, where it is switched to an X-band mode with v=1/20. There is a clear step change in q, hence a step change in $V_{RF}$. Again, it is clearly impossible to fit a smooth function over the whole mass to charge ratio (m/z) range. Note that the step here is smaller than in FIG. 23; in general how well the calibration function needs to follow these curves depends on the mass to charge ratio (m/z) accuracy required.

Depending on the mass to charge ratio (m/z) range required the relationship between $V_{RF}$ and mass to charge ratio (m/z) may be taken from one calibration function or the other.

Thus, according to various embodiments, the quadrupole device (control system) may be configured to select one of the two or more (sets of) calibration curves, e.g. depending on the mass to charge ratio at which ions are selected and/or transmitted by (the set mass of) the quadrupole device 10, and to use the selected calibration curve (set) in operation.

As described above, in another mode of operation the operational parameters of the quadrupole device 10 may be scanned continuously to produce a mass spectrum. In this mode, it is beneficial to have a smooth transition between one mode of operation and the other, e.g. to avoid discontinuities.

Several methods allowing continuous scanning over a wide mass to charge ratio (m/z) range with a smooth transition between different X-band modes of operation and non-X-band operation have been described above.

In these continuous scanning modes a single complex calibration function (set) may be required and used.

In modes of operation where the quadrupole mass filter 10 makes a smooth transition between operating in X-band mode to operating in non-X-band mode, e.g. at a specific $V_{RF}$, a single, smoothly changing, calibration function may be used. In these embodiments, the form of the (or each) calibration curve will transition between a function characteristic of non-X-band operation to a function characteristic of X-band operation.

To adequately mass calibrate during operation where the quadrupole device 10 transitions between these two modes, the mass to charge ratio (m/z) calibration function (set) may be of a form which reflects these different characteristics and the characteristic at the region of transition.

Therefore according to various other embodiments, a calibration function (set) is provided of a form designed to reflect the transition between these two different regimes, e.g. as $V_{RF}$ is altered.

In these embodiments, a first and second calibration function (set) may be defined and used as described above, e.g. where the first calibration function (set) is used for a first mass to charge ratio range and the second different calibration function (set) is used for a second different mass to charge ratio range (where the first and second calibration functions (or each calibration function within each set) may each be a continuous function, and where the first and second calibration functions (or each respective calibration function within the first and second calibration function sets) may be mutually discontinuous), but a third "transition" (continuous) calibration function (set) may additionally be used for a third different mass to charge ratio range, e.g. that is intermediate to the first and second mass to charge ratio ranges. The third calibration function (set) may be configured such that the combination of the first, second and third functions (or of each respective calibration function within the first, second and third calibration function set) is substantially continuous.

FIGS. 25-28 show calibration curves for a system where a smooth transition from normal quadrupole mode to X-band mode (v=1/20) is made, while maintaining a peak width of 0.65 Da. "True" X-band operation occurs at a mass to charge ratio (m/z) of approximately 200. While none of these transition calibration curves are linear, they are all smooth functions, so it would be possible to operate a scanning quadrupole ion this fashion and obtain a smooth mass to charge ratio (m/z) calibration.

Figure 29:
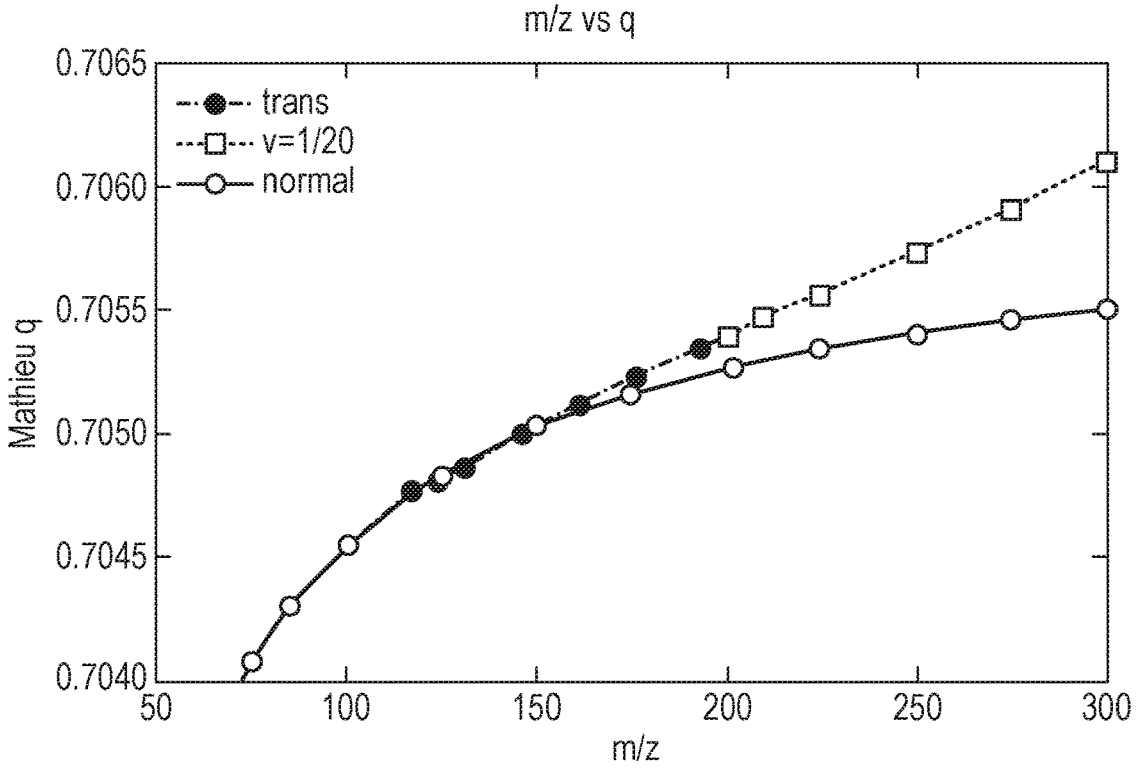
FIG. 29 shows a calibration curve for a quadrupole mass filter operating in a normal mode of operation and an X-band mode of operation, where v=1/20.

FIG. 29 shows a zoomed in region of the calibration curve plotting mass to charge ratio (m/z) versus Mathieu q, for the smooth transition system. The calibration curves for the normal and X-band modes are also plotted. It can be seen that for the smooth transition system the q curve follows the normal quadrupole curve at low mass, and deviates above m/z~150 to smoothly match to the curve for the X-band mode with v=1/20. Hence it is possible to obtain a smooth calibration with no discontinuities.

According to various embodiments, the quadrupole device 10 may be part of an analytical instrument such as a mass and/or ion mobility spectrometer. The analytical instrument may be configured in any suitable manner.

Figure 30:
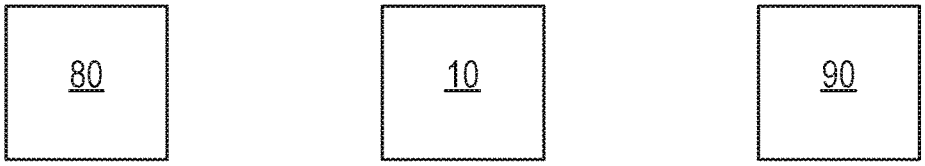
FIGS. 30 and 31 show schematically various analytical instruments comprising a quadrupole device in accordance with various embodiments.

FIG. 30 shows an embodiment comprising an ion source 80, the quadrupole device 10 downstream of the ion source 80, and a detector 90 downstream of the quadrupole device 10.

Ions generated by the ion source 80 may be injected into the quadrupole device 10. The plural voltages applied to the quadrupole device 10 may cause the ions to be radially confined within the quadrupole device 10 and/or to be selected or filtered according to their mass to charge ratio, e.g. as they pass through the quadrupole device 10.

Ions that emerge from the quadrupole device 10 may be detected by the detector 90. An orthogonal acceleration time of flight mass analyser may optionally be provided, e.g. adjacent the detector 90

Figure 31:
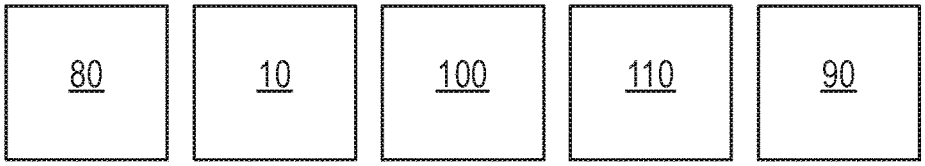

FIG. 31 shows a tandem quadrupole arrangement comprising a collision, fragmentation or reaction device 100 downstream of the quadrupole device 10, and a second quadrupole device 110 downstream of the collision, fragmentation or reaction device 100. In various embodiments, one or both quadrupoles may be operated in the manner described above.

In these embodiments, the ion source 80 may comprise any suitable ion source. For example, the ion source 80 may be selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; (xxix) a Surface Assisted Laser Desorption Ionisation ("SALDI") ion source; and (xxx) a Low Temperature Plasma ("LTP") ion source.

The collision, fragmentation or reaction device 100 may comprise any suitable collision, fragmentation or reaction device. For example, the collision, fragmentation or reaction device 100 may be selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

Various other embodiments are possible. For example, one or more other devices or stages may be provided upstream, downstream and/or between any of the ion source 80, the quadrupole device 10, the fragmentation, collision or reaction device 100, the second quadrupole device 110, and the detector 90.

For example, the analytical instrument may comprise a chromatography or other separation device upstream of the ion source 80. The chromatography or other separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The analytical instrument may further comprise: (i) one or more ion guides; (ii) one or more ion mobility separation devices and/or one or more Field Asymmetric Ion Mobility Spectrometer devices; and/or (iii) one or more ion traps or one or more ion trapping regions.

Although the present invention has been described with reference to preferred embodiments, it will be understood by those skilled in the art that various changes in form and detail may be made without departing from the scope of the invention as set forth in the accompanying claims.

The invention claimed is:

1. A method of operating a quadrupole device comprising:

operating the quadrupole device in a first mode of operation, wherein ions within a first mass to charge ratio range are selected and/or transmitted by the quadrupole device; and operating the quadrupole device in a second mode of operation, wherein ions within a second different mass to charge ratio range are selected and/or transmitted by the quadrupole device;

wherein operating the quadrupole device in the first mode of operation comprises operating the quadrupole device in a normal mode of operation wherein a main drive voltage is applied to the quadrupole device, or operating the quadrupole device in a first X-band or Y-band mode of operation wherein a main drive voltage and two or more auxiliary drive voltages are applied to the quadrupole device; and wherein operating the quadrupole device in the second mode of operation comprises operating the quadrupole device in a second X-band or Y-band mode of operation wherein a main drive voltage and two or more auxiliary drive voltages are applied to the quadrupole device;

wherein in the first and/or second X-band or Y-band mode of operation:

the main drive voltage has a main drive voltage frequency $\Omega$ and the two or more auxiliary drive voltages comprise a first auxiliary drive voltage having a first frequency $\omega_{ex1}$, and a second auxiliary drive voltage having a second different frequency $\omega_{ex2}$, wherein the main drive voltage frequency $\Omega$ and the first and second frequencies $\omega_{ex1}$, $\omega_{ex2}$ are related by $\omega_{ex1}=v_1\Omega$, and $\omega_{ex2}=v_2\Omega$, where $v_1$ and $v_2$ are constants.

2. A method as claimed in claim 1, wherein operating the quadrupole device in the first mode of operation comprises operating the quadrupole device with a first resolution, and wherein operating the quadrupole device in the second mode of operation comprises operating the quadrupole device with a second different resolution.

3. A method as claimed in claim 2, wherein:

the first mass to charge ratio range is at least partially lower than the second mass to charge ratio range; and the first resolution is less than the second resolution.

4. A method as claimed in claim 1, further comprising altering the resolution of the quadrupole device in the first and/or second mode of operation.

5. A method as claimed in claim 4, further comprising:

altering the mass to charge ratio or mass to charge ratio range at which ions are selected and/or transmitted by the quadrupole device in the first and/or second mode of operation; and altering the resolution of the quadrupole device in dependence on the mass to charge ratio or mass to charge ratio range at which ions are selected and/or transmitted by the quadrupole device.

6. A method as claimed in claim 5, further comprising:

increasing the resolution of the quadrupole device while increasing the mass to charge ratio or mass to charge ratio range at which ions are selected and/or transmitted by the quadrupole device; or decreasing the resolution of the quadrupole device while decreasing the mass to charge ratio or mass to charge ratio range at which ions are selected and/or transmitted by the quadrupole device.

7. A method as claimed in claim 4, comprising altering the resolution of the quadrupole device by: (i) altering an amplitude of one or more of the auxiliary drive voltages; (ii)

altering an amplitude ratio between the auxiliary drive voltages and the main drive voltage; (iii) altering an amplitude ratio between two or more of the auxiliary drive voltages; (iv) altering a frequency of one or more of the auxiliary drive voltages; (v) altering a frequency ratio between one or more of the auxiliary drive voltages and the main drive voltage; (vi) altering a frequency ratio between two or more of the auxiliary drive voltages; (vii) altering the duty cycle of the main drive voltage; and/or (viii) altering an amplitude ratio between a DC voltage applied to the quadrupole device and the main drive voltage.

8. A method as claimed in claim 1, wherein:

operating the quadrupole device in the first mode of operation comprises operating the quadrupole device in a normal mode of operation wherein a main drive voltage is applied to the quadrupole device; and operating the quadrupole device in the second mode of operation comprises operating the quadrupole device in an X-band or Y-band mode of operation wherein a main drive voltage and two or more auxiliary drive voltages are applied to the quadrupole device.

9. A method as claimed in claim 8, further comprising altering the resolution of the quadrupole device by altering the amplitudes of the two or more auxiliary drive voltages.

10. A method as claimed in claim 1, wherein:

operating the quadrupole device in the first mode of operation comprises operating the quadrupole device in a first X-band or Y-band mode of operation wherein a main drive voltage and two or more auxiliary drive voltages are applied to the quadrupole device; and operating the quadrupole device in the second mode of operation comprises operating the quadrupole device in a second different X-band or Y-band mode of operation wherein a main drive voltage and two or more auxiliary drive voltages are applied to the quadrupole device.

11. A method as claimed in claim 10, wherein:

in the first X-band or Y-band mode of operation the two or more auxiliary drive voltages comprise a particular auxiliary drive voltage pair type; and in the second different X-band or Y-band mode of operation the two or more auxiliary drive voltages comprises a different auxiliary drive voltage pair type.

12. A method as claimed in claim 1, wherein:

operating the quadrupole device in the first mode of operation comprises operating the quadrupole device in a Y-band mode of operation wherein a main drive voltage and two or more auxiliary drive voltages are applied to the quadrupole device; and operating the quadrupole device in the second mode of operation comprises operating the quadrupole device in an X-band mode of operation wherein a main drive voltage and two or more auxiliary drive voltages are applied to the quadrupole device.

13. A method as claimed in claim 12, further comprising altering the resolution of the quadrupole device by altering an amplitude ratio between two or more of the auxiliary drive voltages.

14. A method as claimed in claim 1, wherein in the first and/or second X-band or Y-band mode of operation:

each of the two or more auxiliary drive voltages has a different frequency to the main drive voltage; and/or the two or more auxiliary drive voltages comprise two or more auxiliary drive voltages having at least two different frequencies; and/or the first and second auxiliary drive voltages comprises (i) a first auxiliary drive voltage pair type, wherein $v_1=v$ and $v_2=1-v$; (ii) a second auxiliary drive voltage pair type, wherein $v_1=v$ and $v_2=1+v$; (iii) a third auxiliary drive voltage pair type, wherein $v_1=1-v$ and $v_2=2-v$; (iv) a fourth auxiliary drive voltage pair type, wherein $v_1=1-v$ and $v_2=2+v$; (v) a fifth auxiliary drive voltage pair type, wherein $v_1=1+v$ and $v_2=2-v$; or (vi) a sixth auxiliary drive voltage pair type, wherein $v_1=1+v$ and $v_2=2+v$; and/or the two or more auxiliary drive voltages comprise a first auxiliary drive voltage having a first amplitude $V_{ex1}$, and a second auxiliary drive voltage having a second different amplitude $V_{ex2}$, wherein the absolute value of the ratio of the second amplitude to the first amplitude $V_{ex2}/V_{ex1}$ is in the range 1-10.

15. A method as claimed in claim 1, wherein:

the method further comprises applying one or more DC voltage to the quadrupole device; and/or the main drive voltage and/or the two or more auxiliary drive voltages comprise a digital drive voltage.

16. A method as claimed in claim 1, further comprising:

operating the quadrupole device in the first mode of operation using a first calibration function; and operating the quadrupole device in the second mode of operation using a second different calibration function.

17. A method of operating a quadrupole device comprising:

operating the quadrupole device in a first mode of operation, wherein ions within a first mass to charge ratio range are selected and/or transmitted by the quadrupole device; and operating the quadrupole device in a second mode of operation, wherein ions within a second different mass to charge ratio range are selected and/or transmitted by the quadrupole device;

wherein operating the quadrupole device in the first mode of operation comprises operating the quadrupole device using a first calibration function; and wherein operating the quadrupole device in the second mode of operation comprises operating the quadrupole device using a second different calibration function.

18. A method of mass and/or ion mobility spectrometry comprising:

operating a quadrupole device using the method of claim 1; and passing ions though the quadrupole device such that the ions are selected and/or filtered according to their mass to charge ratio.

19. Apparatus comprising:

a quadrupole device; and a control system;

wherein the control system is configured:

(i) to operate the quadrupole device in a first mode of operation, wherein ions within a first mass to charge ratio range are selected and/or transmitted by the quadrupole device; and (ii) to operate the quadrupole device in a second mode of operation, wherein ions within a second different mass to charge ratio range are selected and/or transmitted by the quadrupole device;

wherein the control system is configured to operate the quadrupole device in the first mode of operation by operating the quadrupole device in a normal mode of operation wherein a main drive voltage is applied to the quadrupole device, or by operating the quadrupole device in a first X-band or Y-band mode of operation wherein a main drive voltage and two or more auxiliary drive voltages are applied to the quadrupole device; and wherein the control system is configured to operate the quadrupole device in the second mode of operation by operating the quadrupole device in a second X-band or Y-band mode of operation wherein a main drive voltage and two or more auxiliary drive voltages are applied to the quadrupole device;

wherein in the first and/or second X-band or Y-band mode of operation:

the main drive voltage has a main drive voltage frequency $\Omega$ and the two or more auxiliary drive voltages comprise a first auxiliary drive voltage having a first frequency $\omega_{ex1}$, and a second auxiliary drive voltage having a second different frequency $\omega_{ex2}$, wherein the main drive voltage frequency $\Omega$ and the first and second frequencies $\omega_{ex1}$, $\omega_{ex2}$ are related by $\omega_{ex1}=v_1\Omega$, and $\omega_{ex2}=v_2\Omega$, where $v_1$ and $v_2$ are constants.

20. A mass and/or ion mobility spectrometer comprising apparatus as claimed in claim 19.

* * * * *